US011534894B2

(12) United States Patent
Davis

(10) Patent No.: US 11,534,894 B2
(45) Date of Patent: Dec. 27, 2022

(54) SOCKET DEVICES AND METHODS OF USE

(71) Applicant: THE REACTION WASHER COMPANY LLC, Springville, UT (US)

(72) Inventor: John D. Davis, Herriman, UT (US)

(73) Assignee: THE REACTION WASHER COMPANY LLC, Springville, UT (US)

( * ) Notice: Subject to any disclaimer, the term of this patent is extended or adjusted under 35 U.S.C. 154(b) by 221 days.

(21) Appl. No.: 16/950,727

(22) Filed: Nov. 17, 2020

(65) Prior Publication Data

US 2022/0152789 A1 May 19, 2022

(51) Int. Cl.
*B25B 13/06* (2006.01)
*B25B 23/10* (2006.01)

(52) U.S. Cl.
CPC ..... *B25B 13/06* (2013.01); *B25B 23/10* (2013.01)

(58) Field of Classification Search
CPC ..... B25B 13/06; B25B 23/10; B25B 23/005; B25B 23/0071
USPC ..... 81/121.1
See application file for complete search history.

(56) References Cited

U.S. PATENT DOCUMENTS 605,788 A 6/1898 Johnson
625,529 A 5/1899 Andress
910,712 A 1/1909 Mccoy
1,099,410 A 6/1914 Walker
1,101,461 A 6/1914 Maynard
1,911,384 A 5/1933 Olson
2,271,732 A 2/1942 Chappius
2,272,118 A 2/1942 Imse et al.
3,077,218 A 2/1963 Ernst
3,181,584 A 5/1965 Gordon
(Continued)

FOREIGN PATENT DOCUMENTS

CN 2241793 Y 12/1996
CN 105269504 A 1/2016
(Continued)

OTHER PUBLICATIONS

Office Action, U.S. Appl. No. 16/213,269, Notification Date: Apr. 20, 2020, 33 Pages.
(Continued)

*Primary Examiner* — Joseph J Hail
*Assistant Examiner* — Caleb Andrew Holizna
(74) *Attorney, Agent, or Firm* — Jacob Ong; Ongs Law Firm PLLC

(57) ABSTRACT

A socket assembly may include a fastener socket and a contact member. The contact member may extend through a window formed in the fastener socket in a first direction to engage a fastener head and lock the socket assembly to the fastener head in a locked position. The contact member may also retract at least partially into the window in a second direction to disengage the contact member from the fastener head and unlock the socket assembly from the fastener head in an unlocked position. A threaded actuator may be rotated to transform the socket assembly between the locked position and the unlocked position. The contact member may comprise a tang having first and second tang projections configured to engage first and second surfaces of the fastener head and lock the socket assembly to the fastener head.

15 Claims, 13 Drawing Sheets

(56) References Cited

U.S. PATENT DOCUMENTS

| | | | |
|---|---|---|---|
| 3,260,293 | A | 7/1966 | Gohs |
| 3,263,727 | A | 8/1966 | Herpolsheimer |
| 3,332,464 | A | 7/1967 | Castel |
| 3,417,802 | A | 12/1968 | Oldenkott |
| 3,541,844 | A | 11/1970 | Stover |
| 3,581,383 | A | 6/1971 | Tadahira et al. |
| 3,631,910 | A | 1/1972 | Crowther et al. |
| 3,633,446 | A | 1/1972 | Tadahira et al. |
| 3,705,612 | A | 12/1972 | Comley |
| 3,759,119 | A | 9/1973 | Wing |
| 3,895,663 | A | 7/1975 | Bashline et al. |
| 3,926,237 | A | 12/1975 | Enders |
| 4,039,354 | A | 8/1977 | Schober |
| 4,283,091 | A | 8/1981 | Enders |
| 4,538,313 | A | 9/1985 | Frieberg |
| 4,708,555 | A | 11/1987 | Terry |
| 5,011,351 | A | 4/1991 | Terry |
| 5,080,545 | A | 1/1992 | McKinlay |
| 5,318,397 | A | 6/1994 | Junkers |
| 5,341,560 | A | 8/1994 | Junkers |
| 5,499,558 | A | 3/1996 | Junkers |
| 5,533,849 | A | 7/1996 | Burdick |
| 5,538,379 | A | 7/1996 | Junkers |
| 5,539,970 | A | 7/1996 | Junkers |
| 5,626,449 | A | 5/1997 | Mckinlay |
| 5,640,749 | A | 6/1997 | Junkers |
| 5,688,091 | A | 11/1997 | McKinlay |
| 5,829,933 | A | 11/1998 | Kramer |
| 5,946,789 | A | 9/1999 | Junkers |
| 6,039,524 | A | 3/2000 | McKinlay |
| 6,152,243 | A | 11/2000 | Junkers |
| 6,230,589 | B1 | 5/2001 | Junkers |
| 6,254,323 | B1 | 7/2001 | Junkers |
| 6,461,093 | B1 | 10/2002 | Junkers |
| 6,490,952 | B2 | 12/2002 | Junkers |
| 6,609,868 | B2 | 8/2003 | Junkers |
| 6,776,565 | B2 | 8/2004 | Chang |
| 6,883,401 | B2 | 4/2005 | Junkers |
| 6,896,465 | B2 | 5/2005 | Andersson |
| 6,929,439 | B2 | 8/2005 | Junkers |
| 6,986,298 | B2 | 1/2006 | Junkers |
| 7,003,862 | B2 | 2/2006 | Junkers |
| 7,066,053 | B2 | 6/2006 | Junkers |
| 7,125,213 | B2 | 10/2006 | Junkers |
| 7,168,902 | B2 | 1/2007 | Terry |
| 7,188,552 | B1 | 3/2007 | Koppenhoefer |
| 7,207,760 | B2 | 4/2007 | Junkers |
| 7,246,542 | B2 | 7/2007 | Karol |
| 7,261,506 | B2 | 8/2007 | Smolarek |
| 7,306,170 | B1 | 12/2007 | Maksymec |
| 7,462,007 | B2 | 12/2008 | Sullivan et al. |
| D602,349 | S | 10/2009 | Andersson |
| 7,735,397 | B2 | 6/2010 | Junkers |
| 7,950,309 | B2 | 5/2011 | Junkers et al. |
| 8,033,000 | B2 | 10/2011 | Hohmann et al. |
| 8,403,611 | B2 | 3/2013 | Friesen et al. |
| 8,459,919 | B2 | 6/2013 | Ehrler et al. |
| 8,591,157 | B1 | 11/2013 | Stewart et al. |
| 8,631,724 | B2 | 1/2014 | Miyata |
| 8,978,520 | B2 | 3/2015 | Yoshimachi et al. |
| 9,011,060 | B2 | 4/2015 | Hyatt |
| 9,770,815 | B2 | 9/2017 | Scrivens |
| 10,107,325 | B2 | 10/2018 | Davis et al. |
| 2002/0146299 | A1 | 10/2002 | Hewgill |
| 2003/0077143 | A1 | 4/2003 | Smolarek |
| 2003/0190218 | A1 | 10/2003 | Andersson |
| 2004/0047706 | A1 | 3/2004 | Chang |
| 2004/0197160 | A1 | 10/2004 | Junkers |
| 2006/0013670 | A1 | 1/2006 | Sullivan et al. |
| 2007/0098524 | A1 | 5/2007 | Dunlap et al. |
| 2007/0104552 | A1 | 5/2007 | Hewgill |
| 2007/0128003 | A1 | 6/2007 | Shiu |
| 2007/0243040 | A1 | 10/2007 | Chen |
| 2007/0251359 | A1 | 11/2007 | Junkers et al. |
| 2007/0280802 | A1 | 12/2007 | Disantis et al. |
| 2009/0003960 | A1 | 1/2009 | Lin |
| 2010/0239390 | A1 | 9/2010 | Junkers |
| 2011/0220376 | A1 | 9/2011 | Junkers |
| 2012/0125163 | A1 | 5/2012 | Miyata |
| 2013/0180369 | A1 | 7/2013 | Dolan |
| 2013/0202384 | A1 | 8/2013 | Dolan |
| 2014/0377032 | A1 | 12/2014 | Delcher |
| 2016/0003287 | A1 | 1/2016 | Andersson et al. |
| 2016/0067849 | A1 | 3/2016 | Junkers et al. |
| 2016/0375563 | A1 | 12/2016 | Junkers et al. |
| 2017/0021478 | A1 | 1/2017 | Junkers et al. |
| 2017/0122361 | A1 | 5/2017 | Davis et al. |
| 2018/0209469 | A1 | 7/2018 | Dolan |
| 2018/0258970 | A1* | 9/2018 | Avetisian ..... F16B 13/045 |
| 2018/0339377 | A1 | 11/2018 | Schneeberger et al. |
| 2018/0340567 | A1 | 11/2018 | Schneeberger |
| 2019/0003512 | A1 | 1/2019 | Junkers et al. |
| 2019/0003513 | A1 | 1/2019 | Junkers et al. |
| 2019/0120275 | A1 | 4/2019 | Junkers et al. |
| 2019/0136902 | A1 | 5/2019 | Davis et al. |
| 2019/0178282 | A1 | 6/2019 | Davis et al. |
| 2019/0178283 | A1 | 6/2019 | Davis et al. |
| 2019/0178284 | A1 | 6/2019 | Davis et al. |
| 2020/0166071 | A1 | 5/2020 | Schneeberger |
| 2020/0386263 | A1 | 12/2020 | Davis et al. |
| 2020/0400184 | A1 | 12/2020 | Davis |
| 2021/0095710 | A1 | 4/2021 | Junkers et al. |

FOREIGN PATENT DOCUMENTS

| | | | |
|---|---|---|---|
| EP | 1855018 | A2 | 11/2007 |
| EP | 1855018 | A2 | 11/2007 |
| ES | 423660 | A1 | 4/1976 |
| ES | 423660 | A1 | 4/1976 |
| GB | 514923 | A | 11/1939 |
| JP | 2006307965 | A | 11/2006 |
| WO | 2004033139 | A2 | 4/2004 |
| WO | 2004033139 | A3 | 3/2005 |
| WO | 2014015250 | A1 | 1/2014 |
| WO | 2015095425 | A2 | 6/2015 |
| WO | 2015100115 | A2 | 7/2015 |
| WO | 2015109355 | A1 | 7/2015 |
| WO | 2015152728 | A1 | 10/2015 |
| WO | WO2015152728 | | 10/2015 |
| WO | 2015095425 | A3 | 11/2015 |
| WO | 2016176518 | A3 | 12/2016 |
| WO | 2017079685 | A1 | 5/2017 |
| WO | 2018218209 | A1 | 11/2018 |

OTHER PUBLICATIONS

Answer to First Amended Complaint in *Reaction Washer* v. *IDEPA*, U.S. District Court, District of Utah, Civil No. 2:19-cv-00148-DBP, submitted Sep. 19, 2019, 9 Pages.

Assignment of Membership Interest Agreement, Nov. 1, 2018, 3 Pages.

Certificate of Organization and Operating Agreement for The Reaction Washer Company, May 12, 2016, 26 Pages.

CN Series Stretch-to-Load Hytorc Nut, Wayback Machine Capture dated May 10, 2015, 1 Page.

First Amended Complaint in *Reaction Washer* v. *IDEPA*, U.S. District Court, District of Utah, Civil No. 2:19-cv-00148-DBP, submitted Apr. 15, 2019, 22 Pages.

Goff, Jared, Discussion of Assignment of U.S. Appl. No. 14/932,768, Now U.S. Pat. No. 10,107,325 Covering Continuation-in-Part Applications, with assignments attached, Feb. 14, 2020, 12 Pages.

International Preliminary Report on Patentability, PCT/US16/60714, dated Jul. 17, 2017, 16 Pages.

International Search Report and Written Opinion, International PCT Application No. PCT/US2020034890, Agent's File Reference 524-PCT, dated Aug. 12, 2020, 10 Pages.

International Search Report, International Application No. PCT/US18/34746, dated Aug. 28, 2018, 2 Pages.

International Search Report, PCT/US16/60714, dated Mar. 17, 2017, 5 Pages.

(56) References Cited

OTHER PUBLICATIONS

Kirkpatrick, John C., Request for Information and Evidence Under 37 C.F.R. 11.22(f), Aug. 18, 2020, 7 Pages.
Kirkpatrick, John C., Termination of Investigation, Mar. 22, 2021, 1 Page.
Memorandum Decision and Order Granting [97] Defendants' Motion for Summary Judgment and Denying [99] Plaintiff's Motion for Partial Summary Judgment in *Reaction Washer* v. *IDEPA*, U.S. District Court, District of Utah, Civil No. 2:19-cv-00148-DBP, submitted Sep. 19, 2019, 16 Pages.
Office Action, U.S. Appl. No. 14/932,768, Notification Date: Dec. 5, 2017, 6 Pages.
Office Action, U.S. Appl. No. 15/605,861, Notification Date: May 31, 2019, 15 Pages.
Office Action, U.S. Appl. No. 15/605,876, Notification Date: Mar. 12, 2019, 16 Pages.
Office Action, U.S. Appl. No. 16/150,633, Notification Date: Apr. 23, 2020, 31 Pages.
Office Action, U.S. Appl. No. 16/447,660, Notification Date: Jul. 7, 2021, 44 Pages.
Re: Johannes Schneeberger, Letter from Sean Egan, Nov. 12, 2020, 2 Pages.
Search Report, Singapore Patent Application No. 11201803772S, dated Aug. 19, 2019, 3 Pages.
Supplementary European Search Report, European Patent Application No. EP 16863121, dated May 16, 2019, 10 Pages.
U.S. Appl. No. 62/758,676, filed Nov. 11, 2018, listing only Johannes Schneeberger as a purported inventor.
Written Opinion of the International Searching Authority, PCT/US18/34746, dated Aug. 28, 2018, 5 Pages.
Written Opinion, Singapore Patent Application No. 11201803772S, dated Aug. 20, 2019, 7 Pages.
Search Report, Singapore Application No. 11201803772S, dated Aug. 19, 2019, 3 Pages.
International Search Report and Written Opinion dated Aug. 12, 2020 for corresponding PCT Application No. PCT/US2020/034890.

* cited by examiner

SOCKET DEVICES AND METHODS OF USE

TECHNICAL FIELD

The present disclosure relates to socket devices and methods of use. More specifically, the present disclosure relates to socket coupling devices configured to selectively couple and decouple a fastener head.

BACKGROUND

A driver tool can be utilized to apply torque to a fastener head during a tightening or loosening procedure. For example, a driver tool may apply such torque via a fastener socket, which may be kept in engagement with the fastener head during the tightening or loosening procedure.

SUMMARY

In some examples, a socket assembly may include a fastener socket and a tang. The fastener socket may be configured to receive a fastener head therein. The fastener socket may also include a window formed through a side of the fastener socket. The tang may include a first tang projection configured to engage a first surface of the fastener head adjacent a first edge of the fastener head, and a second tang projection configured to engage a second surface of the fastener head. The first edge of the fastener head may be intermediate the first surface of the fastener head and the second surface of the fastener head. The tang may define a tang recess intermediate the first tang projection and the second tang projection. The tang recess may be configured to receive the first edge of the fastener head as the first tang projection engages the first surface of the fastener head and the second tang projection engages the second surface of the fastener head. In a locked position, the tang may extend through the window in a first direction to engage the first surface of the fastener head with the first tang projection and engage the second surface of the fastener head with the second tang projection to lock the socket assembly to the fastener head. In an unlocked position, the tang may be retracted at least partially into the window in a second direction to disengage the first tang projection from the first surface of the fastener head and disengage the second tang projection from the second surface of the fastener head to unlock the socket assembly from the fastener head.

In some examples, the socket assembly may include a plurality of windows formed through the side of the fastener socket and spaced apart from each other. The socket assembly may also include a plurality of tangs spaced apart from each other. The plurality of tangs may be configured to extend through the plurality of windows and engage the fastener head to selectively lock and unlock the socket assembly from the fastener head.

In some examples, the plurality of windows may include three windows spaced apart from each other at 120 degree intervals, and the plurality of tangs may include three tangs spaced apart from each other at 120 degree intervals.

In some examples, each of the plurality of tangs may be configured to rotatably self-align with an edge of the fastener head as the plurality of tangs engage the fastener head.

In some examples, the socket assembly may include a resilient gripper ring and the tang may be coupled to the resilient gripper ring. The socket assembly may also include a lock-on sleeve having a cammed surface configured to engage the resilient gripper ring to selectively extend and retract the tang through the window. In the locked position, the lock-on sleeve may be translated along a first direction to engage the resilient gripper ring with a first portion of the cammed surface to radially compress the resilient gripper ring and extend the tang through the window to lock the socket assembly to the fastener head. In the unlocked position, the lock-on sleeve may be translated along a second direction to engage the resilient gripper ring with a second portion of the cammed surface to radially decompress the resilient gripper ring and retract the tang through the window to unlock the socket assembly from the fastener head.

In some examples, the socket assembly may include a lock-on ring comprising first threading configured to threadably couple with second threading of the fastener socket. Rotating the lock-on ring in a first rotational direction with respect to the fastener socket may translate the lock-on sleeve in a first axial direction with respect to the fastener socket to lock the socket assembly to the fastener head. Rotating the lock-on ring in a second rotational direction with respect to the fastener socket may translate the lock-on sleeve in a second axial direction with respect to the fastener socket to unlock the socket assembly from the fastener head.

In some examples, a bore of the fastener socket may include a taper having a portion that extends above the window that is formed through the side of the fastener socket.

In some examples, a socket assembly may include a fastener socket, a contact member, and a threaded actuator. The fastener socket may be configured to receive a fastener head therein and may include a window formed through a side of the fastener socket. The contact member may be configured to engage the fastener head. The threaded actuator may be configured to be rotated to transform the socket assembly between a locked position and an unlocked position. In the locked position, the contact member may extend through the window in a first direction to engage the fastener head and lock the socket assembly to the fastener head. In the unlocked position, the contact member may be retracted at least partially into the window in a second direction to disengage the contact member from the fastener head and unlock the socket assembly from the fastener head.

In some examples, the contact member may be a contact blade configured to engage the fastener head.

In some examples, the socket assembly may include a plurality of windows formed through the side of the fastener socket and spaced apart from each other. The socket assembly may include a plurality of contact blades spaced apart from each other. The plurality of contact blades may be configured to extend through the plurality of windows and engage the fastener head to selectively lock and unlock the socket assembly from the fastener head.

In some examples, the plurality of windows may include three windows spaced apart from each other at 120 degree intervals, and the plurality of contact blades may include three contact blades spaced apart from each other at 120 degree intervals.

In some examples, the contact member may be a tang. The tang may include a first tang projection configured to engage a first surface of the fastener head adjacent a first edge of the fastener head, and a second tang projection configured to engage a second surface of the fastener head. The first edge of the fastener head may be intermediate the first surface of the fastener head and the second surface of the fastener head. The tang may define a tang recess intermediate the first tang projection and the second tang projection. The tang recess may be configured to receive the first edge of the fastener head as the first tang projection engages the first surface of the fastener head and the second tang projection engages the second surface of the fastener head. In the locked position, the tang may extend through the window in a first direction to engage the first surface of the fastener head with the first tang projection and engage the second surface of the fastener head with the second tang projection to lock the socket assembly to the fastener head. In the unlocked position, the tang may be retracted at least partially into the window in the second direction to disengage the first tang projection from the first surface of the fastener head and disengage the second tang projection from the second surface of the fastener head to unlock the socket assembly from the fastener head.

In some examples, the socket assembly may include a plurality of windows formed through the side of the fastener socket and spaced apart from each other, as well as a plurality of tangs spaced apart from each other. The plurality of tangs may be configured to extend through the plurality of windows and engage the fastener head to selectively lock and unlock the socket assembly from the fastener head.

In some examples, the plurality of windows may include three windows spaced apart from each other at 120 degree intervals, and the plurality of tangs may include three tangs spaced apart from each other at 120 degree intervals.

In some examples, each of the plurality of tangs may be configured to rotatably self-align with an edge of the fastener head as the plurality of tangs engage the fastener head.

In some examples, a socket assembly may include a cap, a reaction socket, and a lock. The lock may be disposed inside the socket assembly and may include a first locking member of a lock ring configured to engage a second locking member. In a locked position, the first locking member may be engaged with the second locking member to lock the cap to the reaction socket. In an unlocked position, the first locking member may be disengaged from the second locking member to unlock the cap from the reaction socket.

In some examples, the socket assembly may include a switch coupled to the lock ring and protruding through a window formed in the cap to permit selective rotation of the lock ring.

In some examples, the socket assembly may be configured to transform between the locked position and the unlocked position due to rotation of the switch relative to the cap.

In some examples, the first locking member may include a plurality of locking projections, and the second locking member may define a plurality of locking grooves. In the locked position, the plurality of locking projections may be engaged with the plurality of locking grooves to lock the cap to the reaction socket. In the unlocked position, the plurality of locking projections may be disengaged from the plurality of locking grooves to unlock the cap from the reaction socket.

In some examples, the cap may include a driver tool connection feature configured to receive a complementary shaped connection feature of a driver tool, as well as a locking member configured to secure the cap to the driver tool.

BRIEF DESCRIPTION OF THE DRAWINGS

Examples of the disclosure will become more fully apparent from the following description taken in conjunction with the accompanying drawings. Understanding that these drawings depict only examples and are, therefore, not to be considered limiting of the scope of the present disclosure, the examples of the present disclosure will be described with additional specificity and detail through use of the accompanying drawings in which.

Figure 1A:
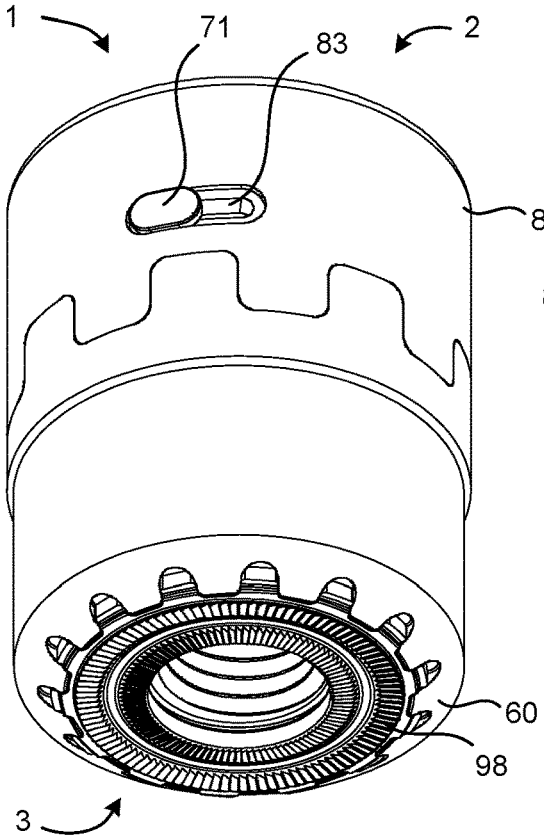
FIG. 1A illustrates a bottom perspective view of a socket assembly, according to some examples of the present disclosure.

It is to be understood that the drawings are for purposes of illustrating the concepts of the disclosure and may not be drawn to scale. Furthermore, the drawings illustrate example examples and do not represent limitations to the scope of the present disclosure.

DETAILED DESCRIPTION

Examples of the present disclosure will be best understood by reference to the drawings, wherein like parts are designated by like numerals throughout. It will be readily understood that the components of the present disclosure, as generally described and illustrated in the drawings, could be arranged, and designed in a wide variety of different configurations. Thus, the following more detailed description of the examples of the devices, systems, and methods, as represented in the drawings, is not intended to limit the scope of the present disclosure, but is merely representative of examples of the present disclosure.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The term "coupled" can include components that are coupled to each other via integral formation, as well as components that are removably and/or non-removably coupled with each other. The term "abutting" refers to items that are in direct physical contact with each other, although the items may not necessarily be attached together. The phrase "in fluid communication with" refers to two features that are connected such that a fluid within one feature is able to pass into the other feature.

The word "example" is used herein to mean "serving as an example, instance, or illustration." Anything described herein as an "example" is not necessarily to be construed as preferred or more advantageous than other options. While the various aspects are presented in drawings, the drawings are not necessarily drawn to scale unless specifically indicated.

Figure 1B:
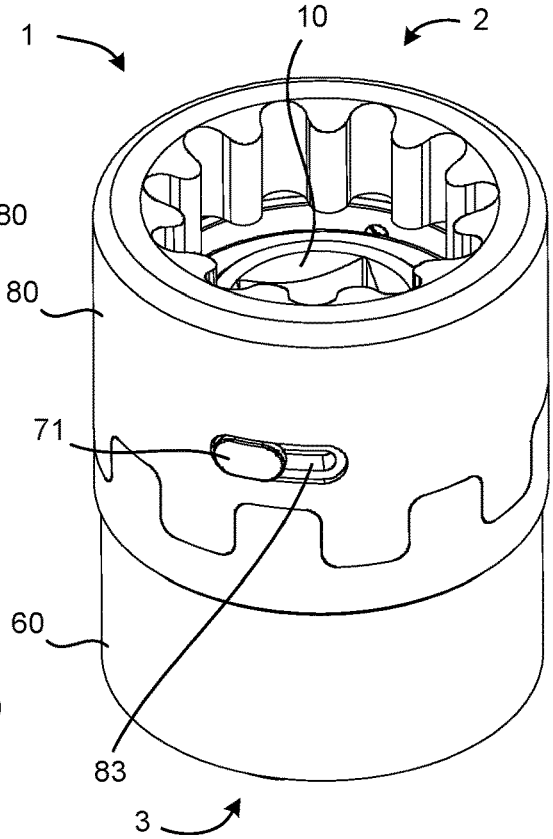
FIG. 1B illustrates a top perspective view of the socket assembly of FIG. 1A.
Figure 1C:
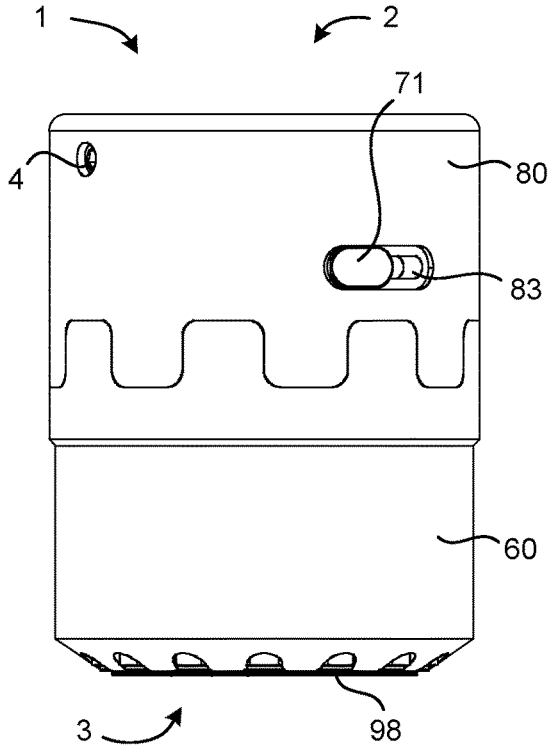
FIG. 1C illustrates a front side view of the socket assembly of FIG. 1A.
Figure 1D:
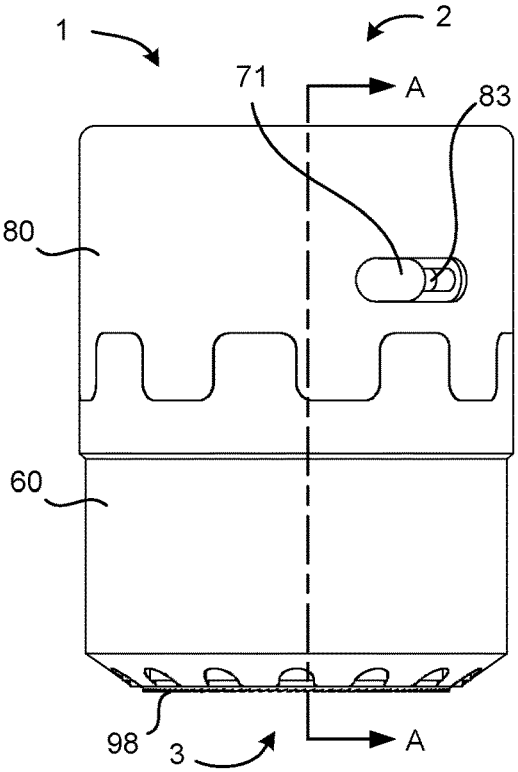
FIG. 1D illustrates a rear side view of the socket assembly of FIG. 1A.
Figure 2:
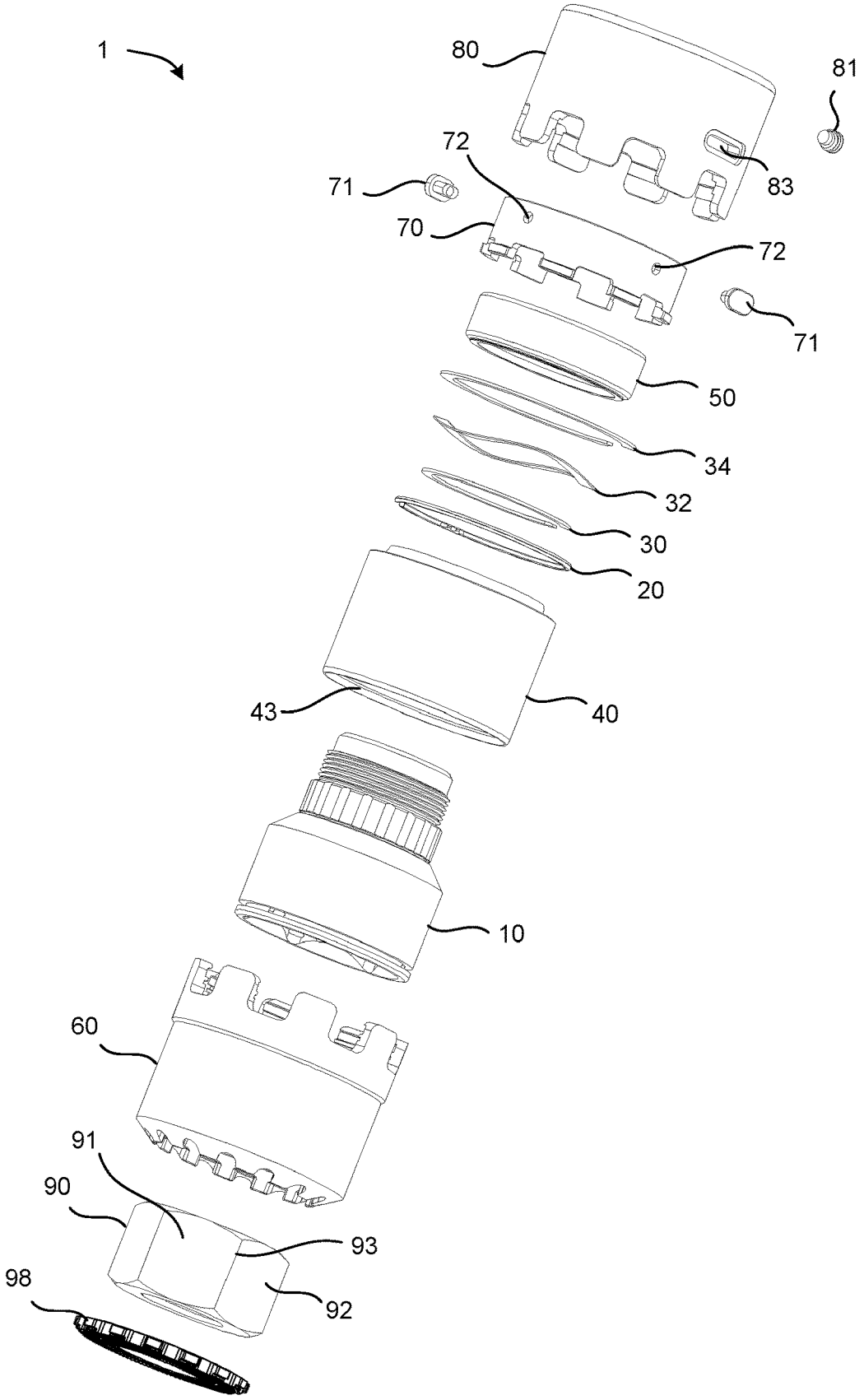
FIG. 2 illustrates an exploded view of the socket assembly of FIG. 1A.
Figure 3:
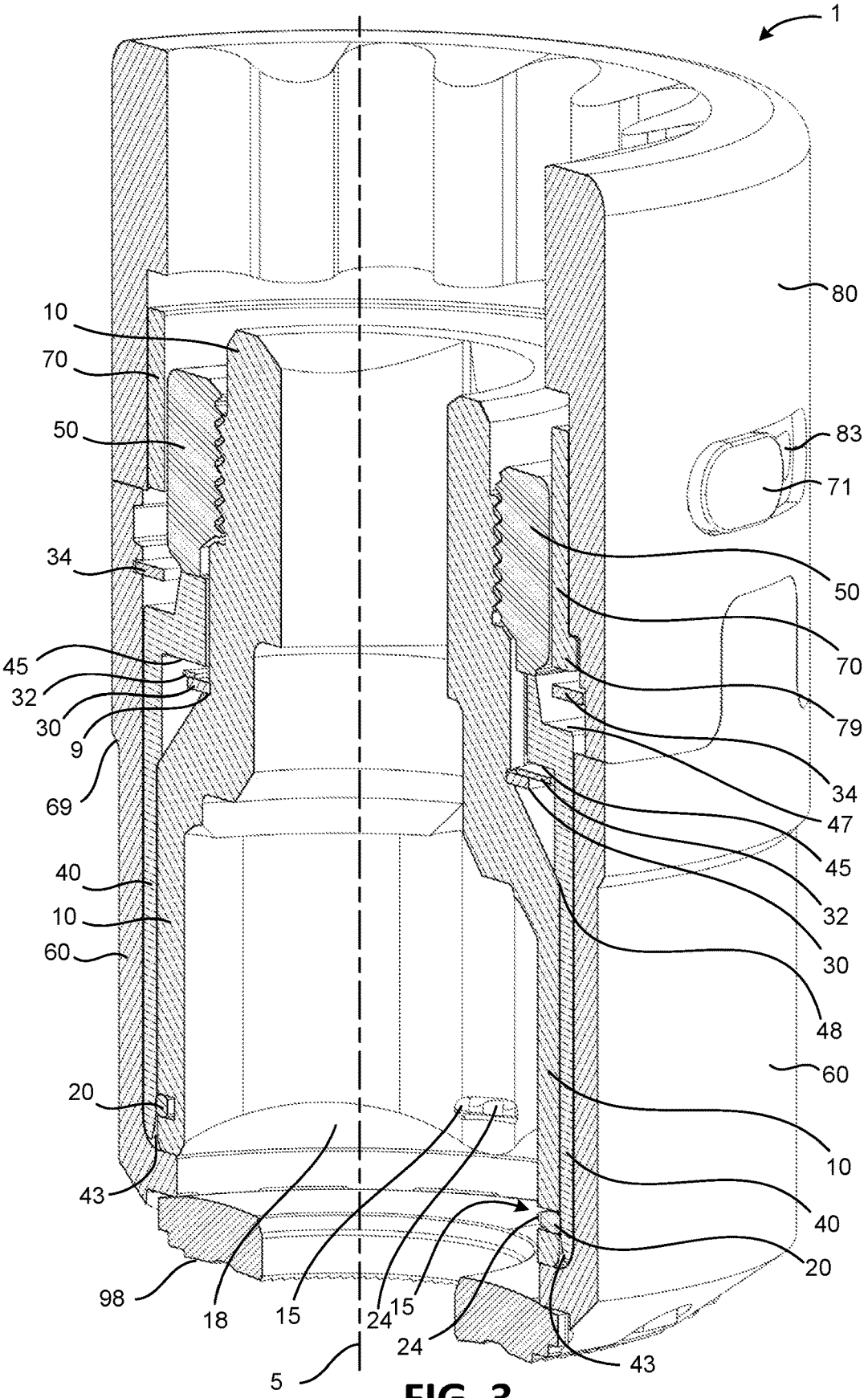
FIG. 3 illustrates a cross-sectional view of the socket assembly of FIG. 1A, taken along the line A-A in FIG. 1D.
Figure 4A:
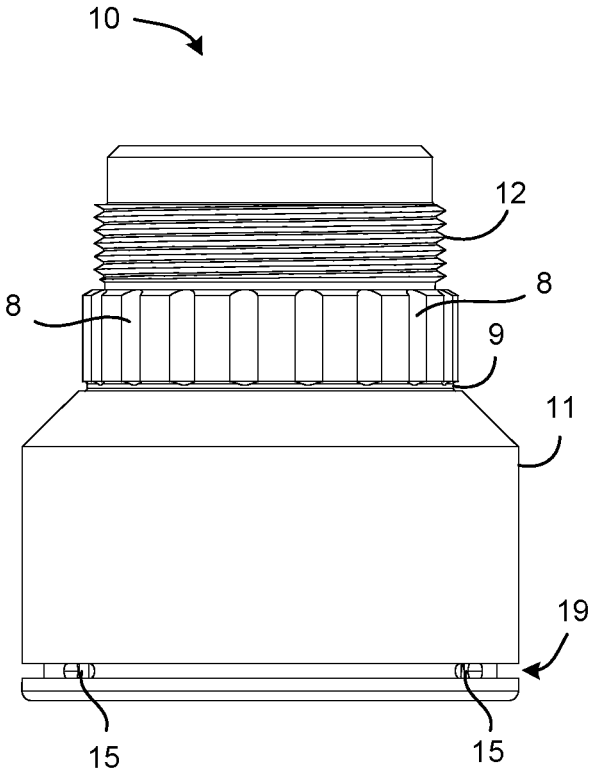
FIG. 4A illustrates a side view of a fastener socket, according to some examples of the present disclosure.
Figure 4B:
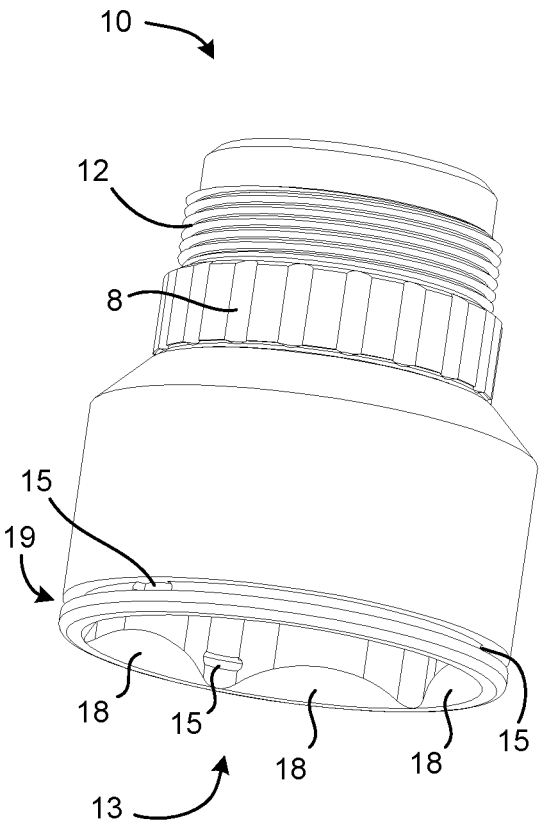
FIG. 4B illustrates a perspective bottom view of the fastener socket of FIG. 4A.
Figure 4C:
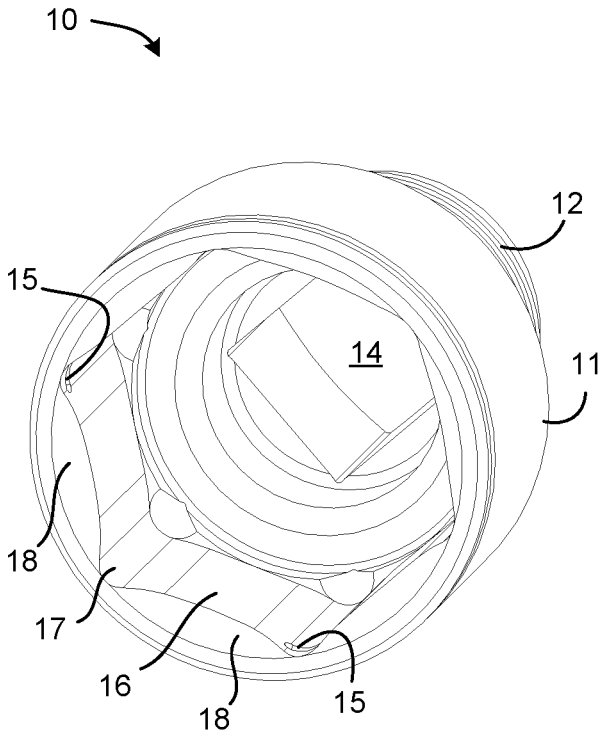
FIG. 4C illustrates another perspective bottom view of the fastener socket of FIG. 4A.
Figure 4D:
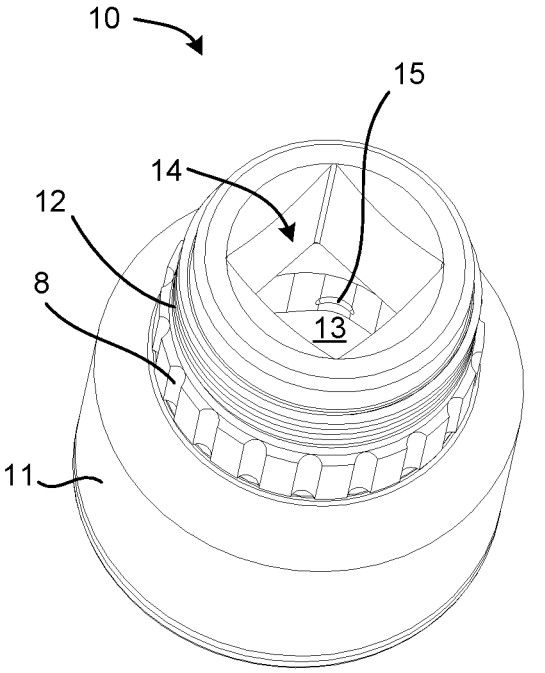
FIG. 4D illustrates a top perspective view of the fastener socket of FIG. 4A.
Figure 5A:
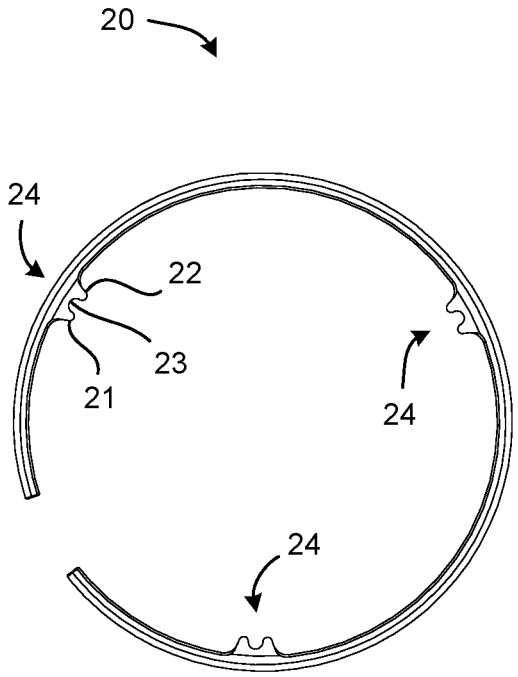
FIG. 5A illustrates a top view of a resilient gripper ring, according to some examples of the present disclosure.
Figure 5B:
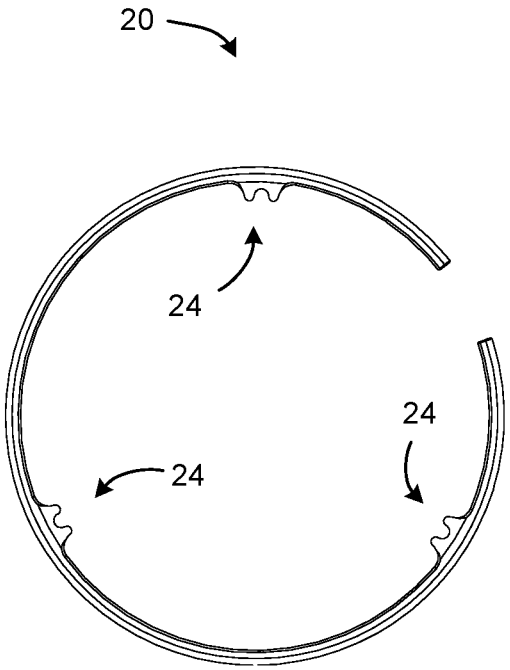
FIG. 5B illustrates a bottom view of the resilient gripper ring of FIG. 5A.
Figure 5C:
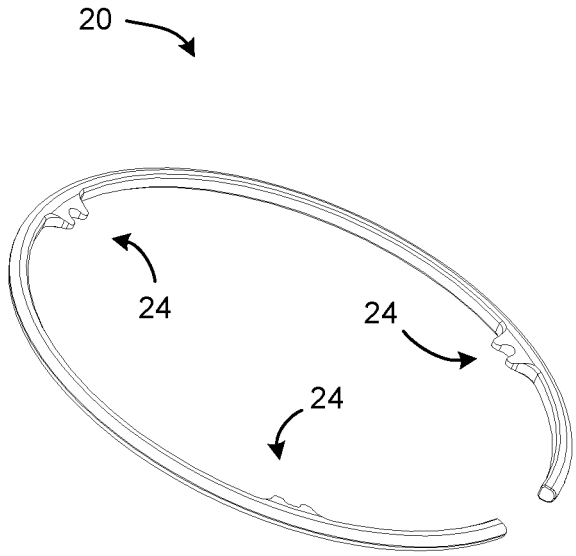
FIG. 5C illustrates a top perspective view of the resilient gripper ring of FIG. 5A.
Figure 5D:
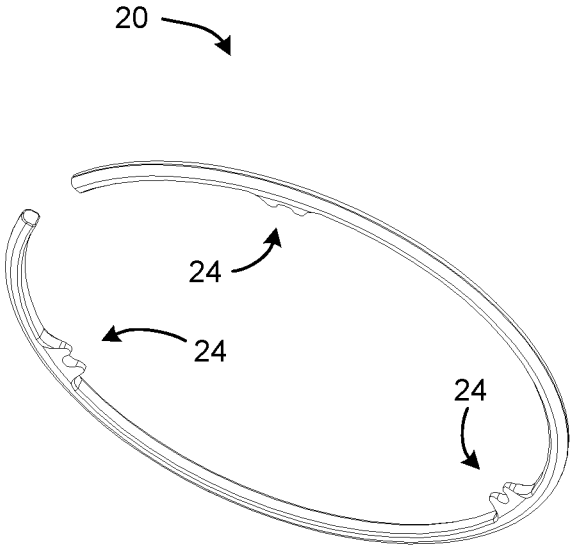
FIG. 5D illustrates a bottom perspective view of the resilient gripper ring of FIG. 5A.
Figure 6A:
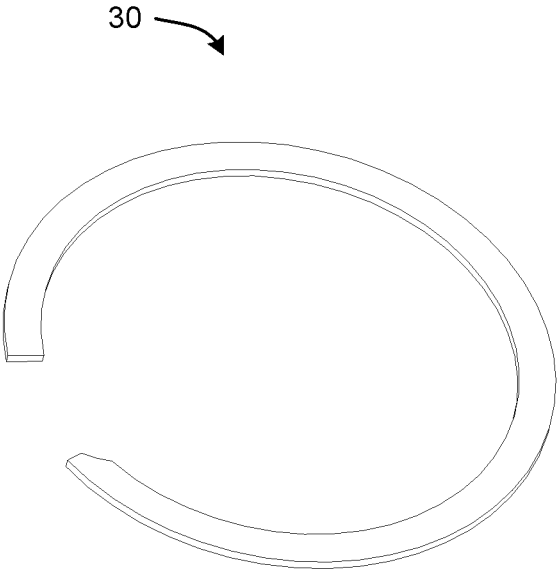
FIG. 6A illustrates a top perspective view of a retaining ring, according to some examples of the present disclosure.
Figure 6B:
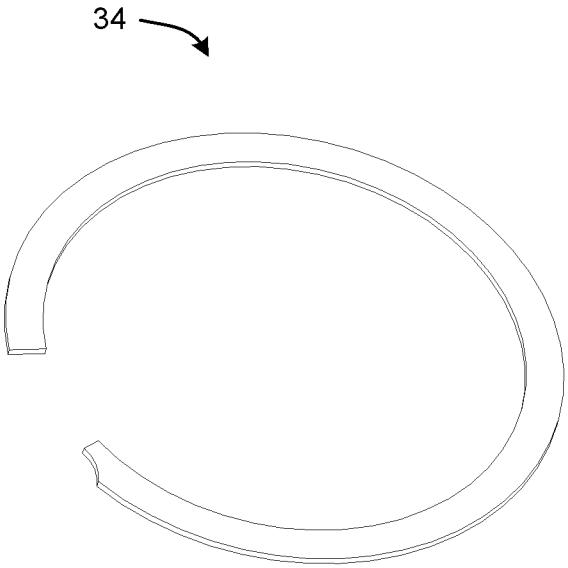
FIG. 6B illustrates a top perspective view of a another retaining ring, according to some examples of the present disclosure.
Figure 6C:
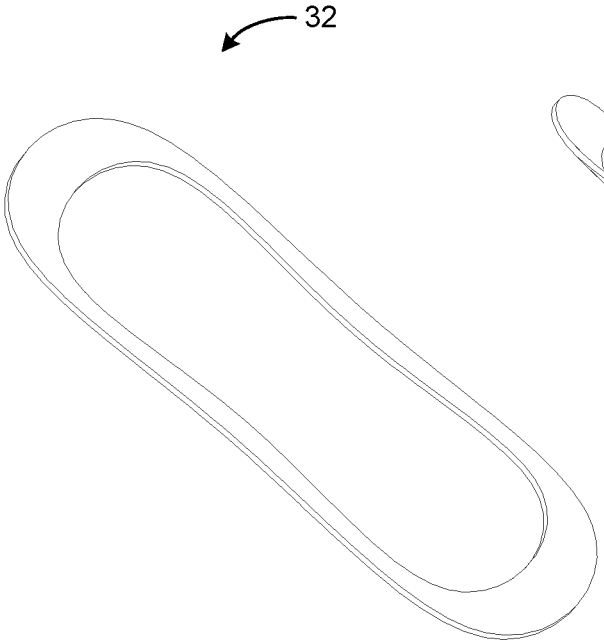
FIG. 6C illustrates a top perspective view of a wave spring, according to some examples of the present disclosure.
Figure 6D:
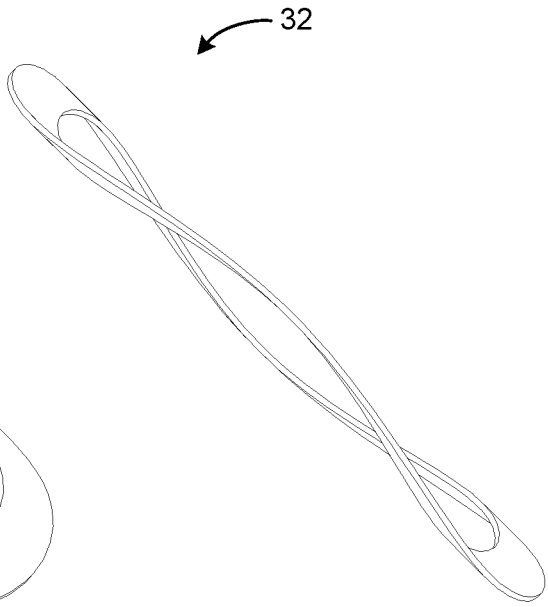
FIG. 6D illustrates a side view of the wave spring of FIG. 6C.
Figure 7A:
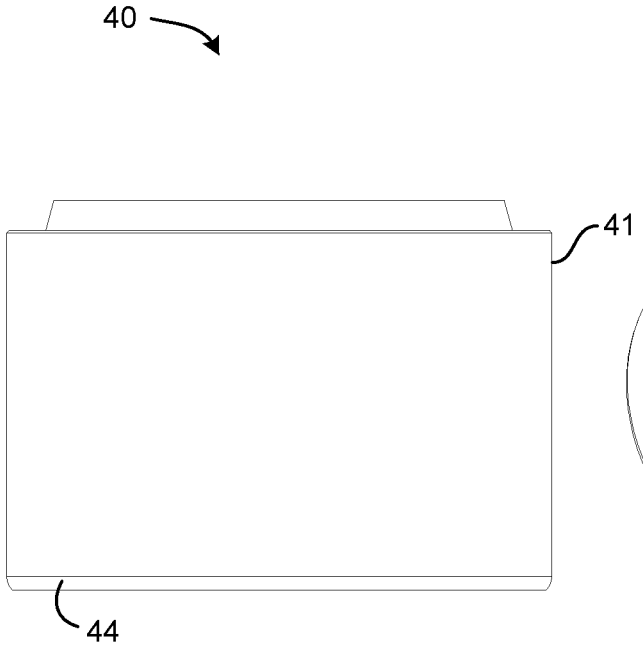
FIG. 7A illustrates a side view of a lock-on sleeve, according to some examples of the present disclosure.
Figure 7B:
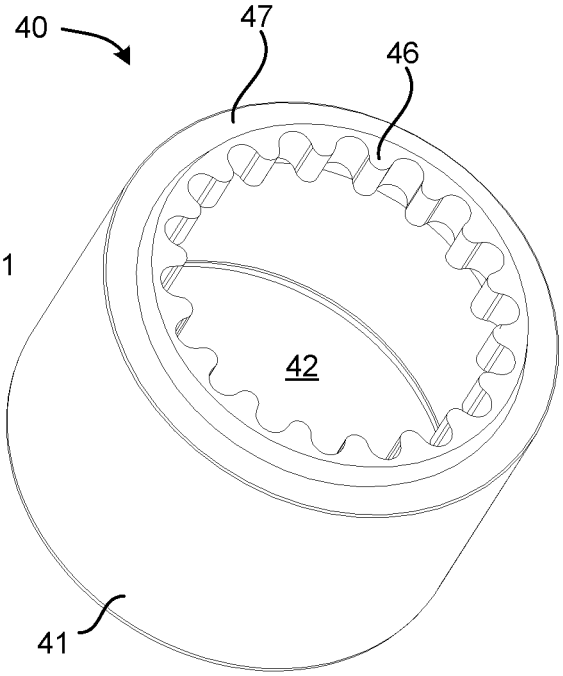
FIG. 7B illustrates a top perspective view of the lock-on sleeve of FIG. 7A.
Figure 7C:
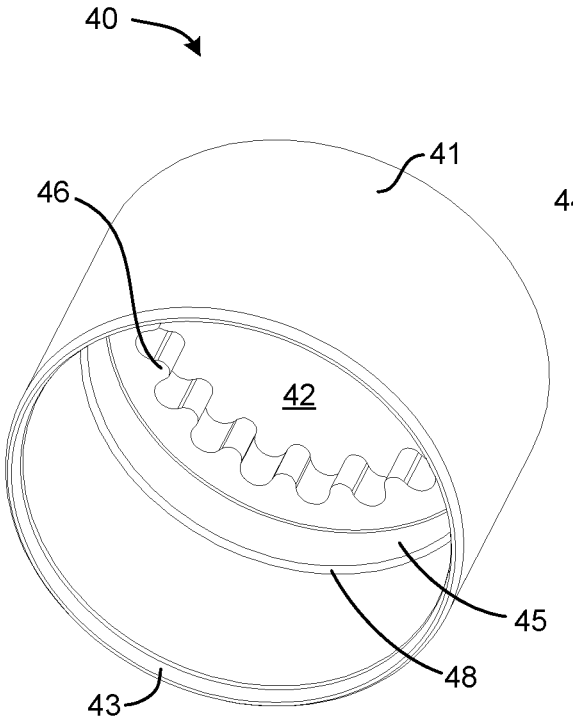
FIG. 7C illustrates a bottom perspective view of the lock-on sleeve of FIG. 7A.
Figure 7D:
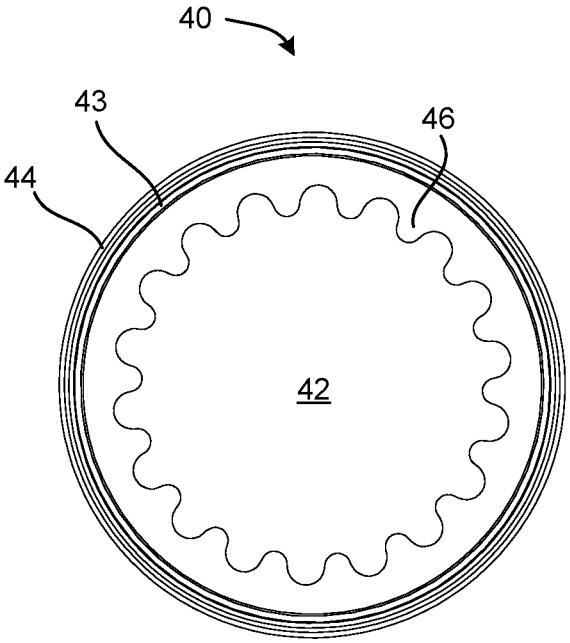
FIG. 7D illustrates a bottom view of the lock-on sleeve of FIG. 7A.
Figure 8A:
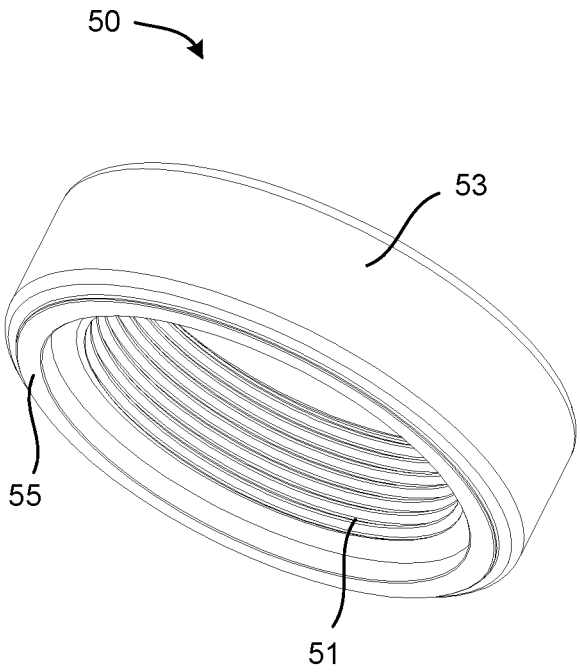
FIG. 8A illustrates a bottom perspective view of a lock-on ring, according to some examples of the present disclosure.
Figure 8B:
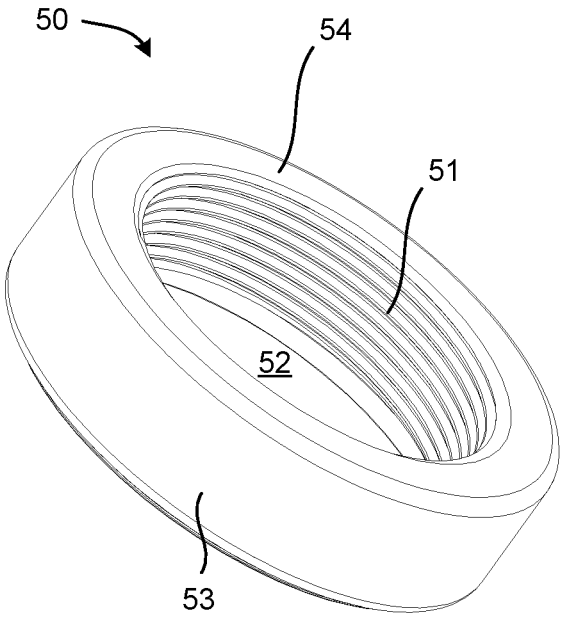
FIG. 8B illustrates a top perspective view of the lock-on ring of FIG. 8A.
Figure 8C:
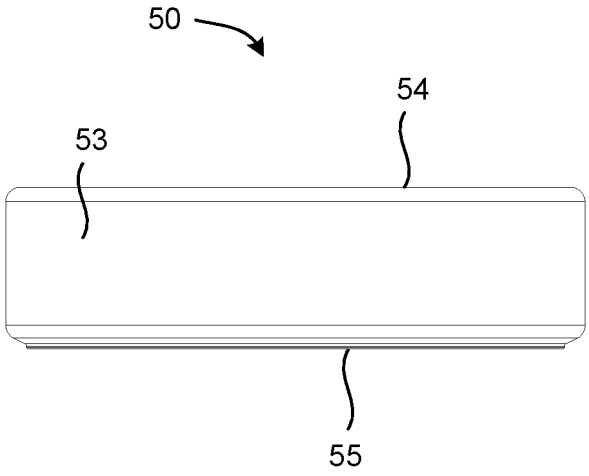
FIG. 8C illustrates a side view of the lock-on ring of FIG. 8A.
Figure 8D:
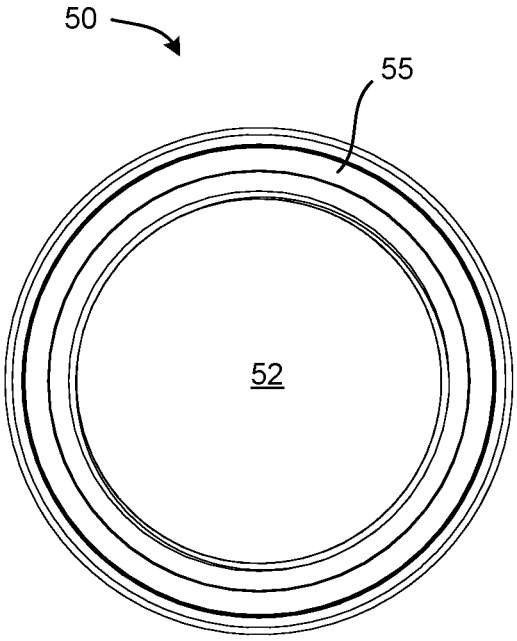
FIG. 8D illustrates a bottom view of the lock-on ring of FIG. 8A.
Figure 9A:
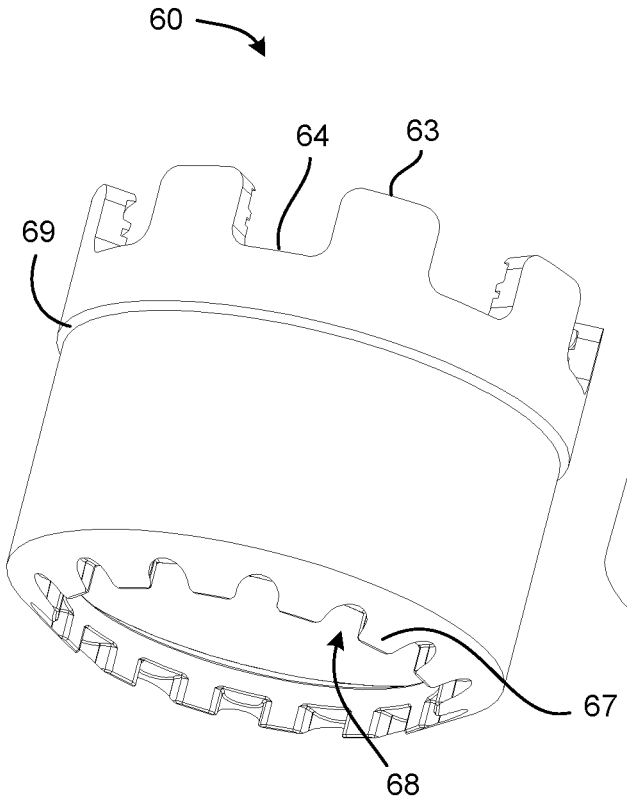
FIG. 9A illustrates a bottom perspective view of a reaction socket, according to some examples of the present disclosure.
Figure 9B:
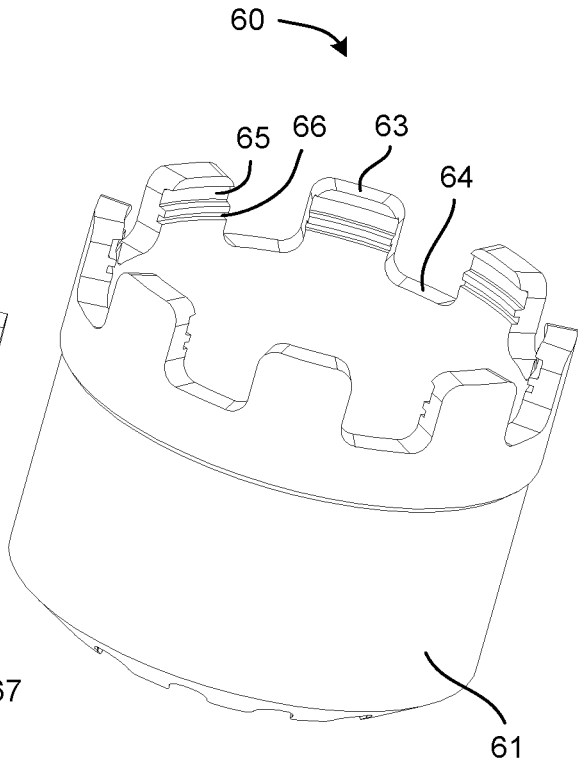
FIG. 9B illustrates a top perspective view of the reaction socket of FIG. 9A.
Figure 9C:
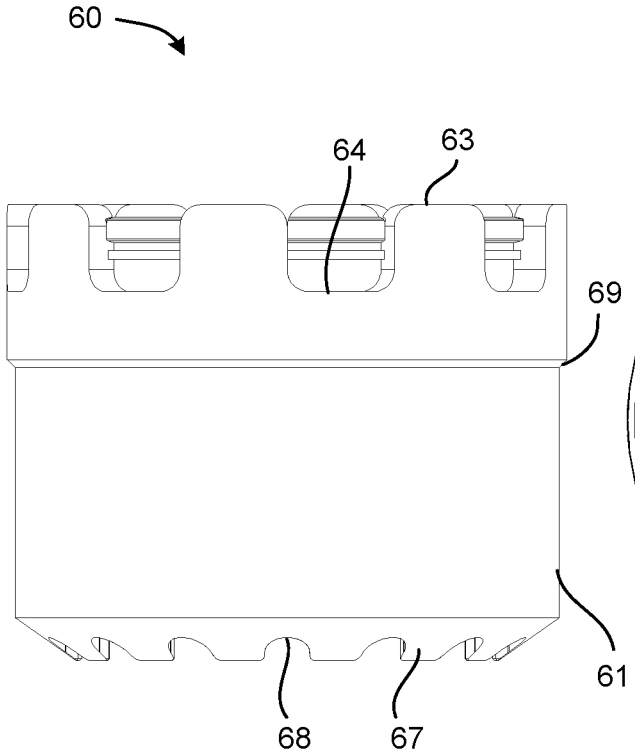
FIG. 9C illustrates a side view of the reaction socket of FIG. 9A.
Figure 9D:
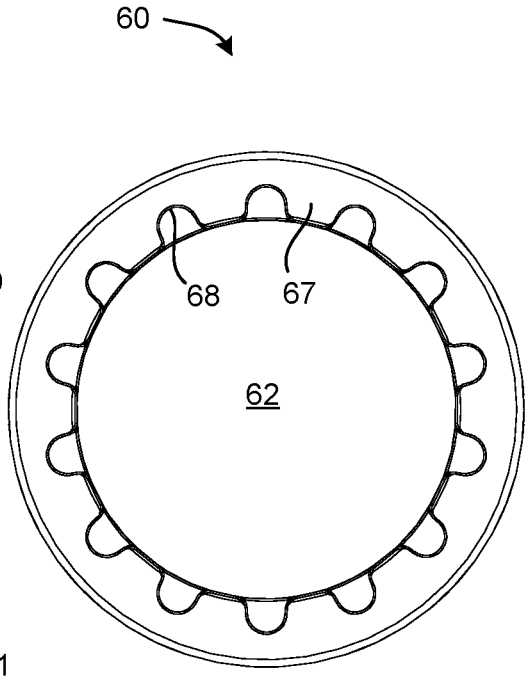
FIG. 9D illustrates a bottom view of the reaction socket of FIG. 9A.
Figure 10A:
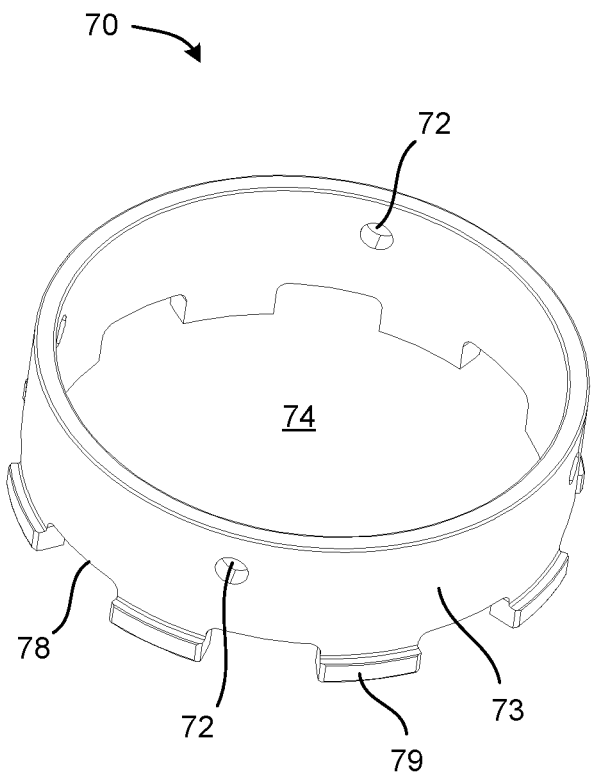
FIG. 10A illustrates a top perspective view of a lock ring, according to some examples of the present disclosure.
Figure 10B:
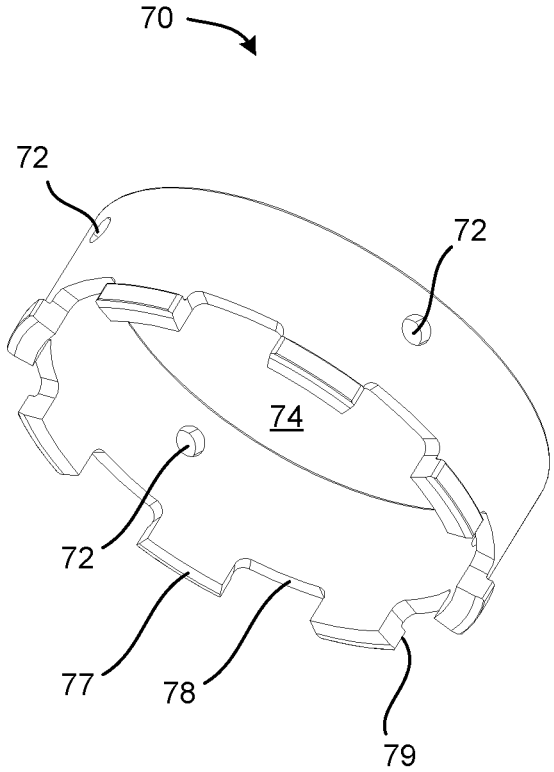
FIG. 10B illustrates a bottom perspective view of the lock ring of FIG. 10A.
Figure 10C:
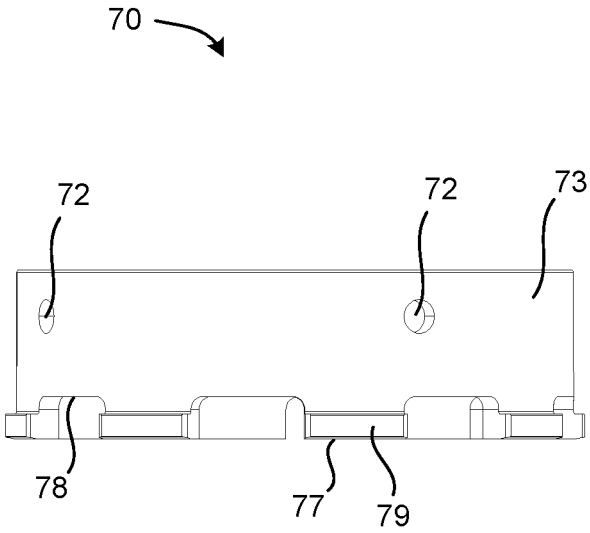
FIG. 10C illustrates a side view of the lock ring of FIG. 10A.
Figure 10D:
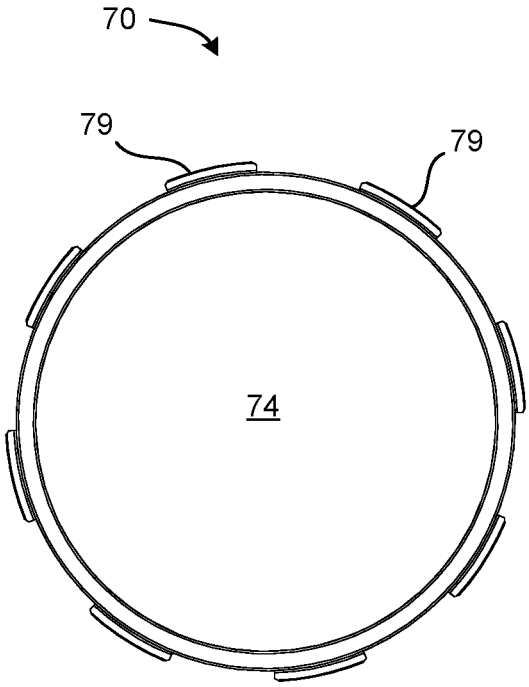
FIG. 10D illustrates a top view of the lock ring of FIG. 10A.
Figure 11A:
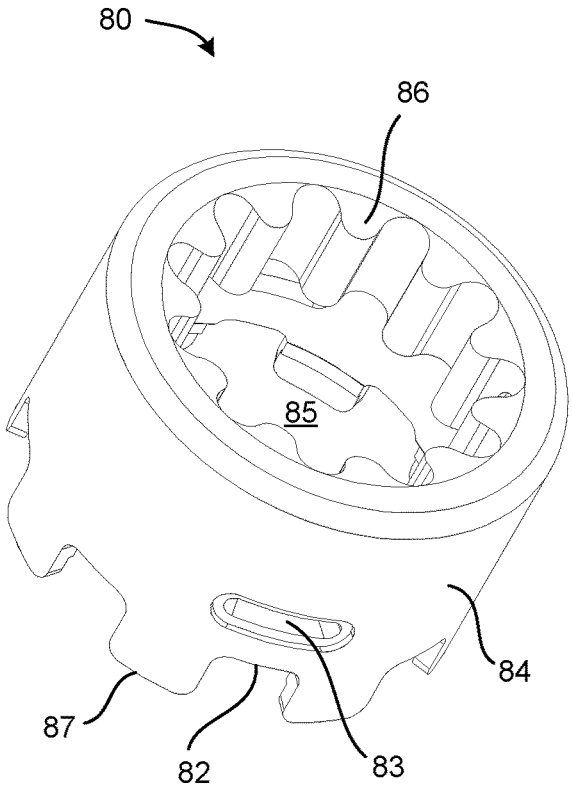
FIG. 11A illustrates a top perspective view of a cap, according to some examples of the present disclosure.
Figure 11B:
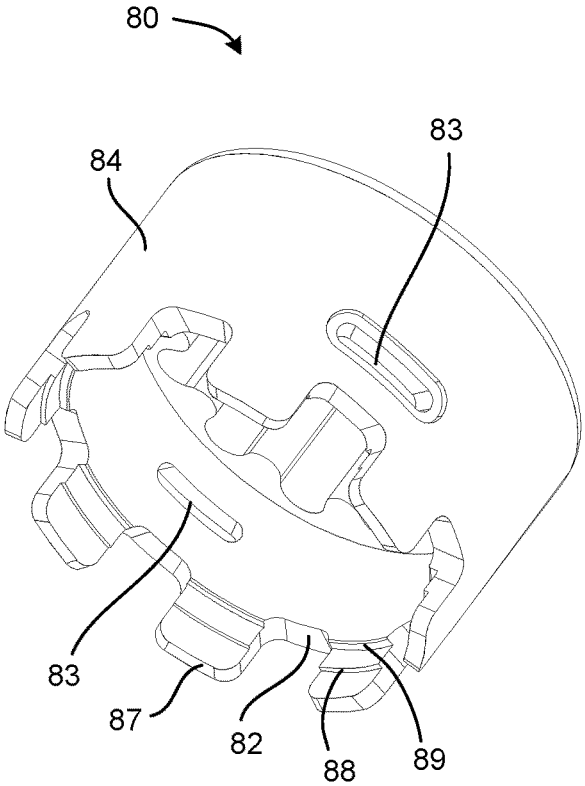
FIG. 11B illustrates a bottom perspective view of the cap of FIG. 11A.
Figure 11C:
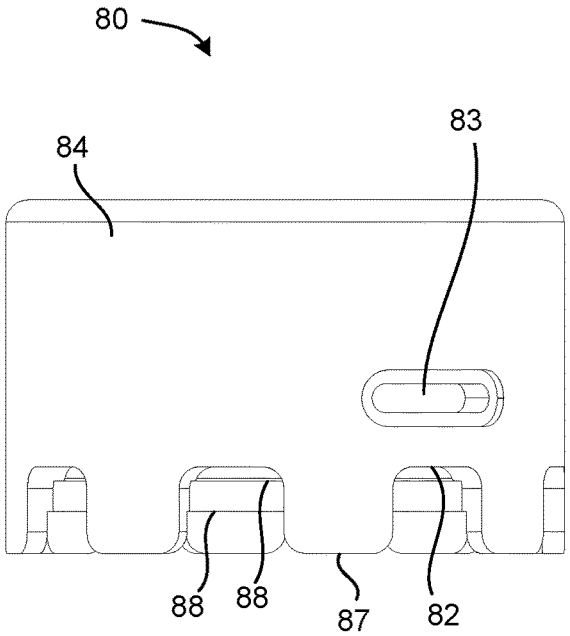
FIG. 11C illustrates a side view of the cap of FIG. 11A.
Figure 11D:
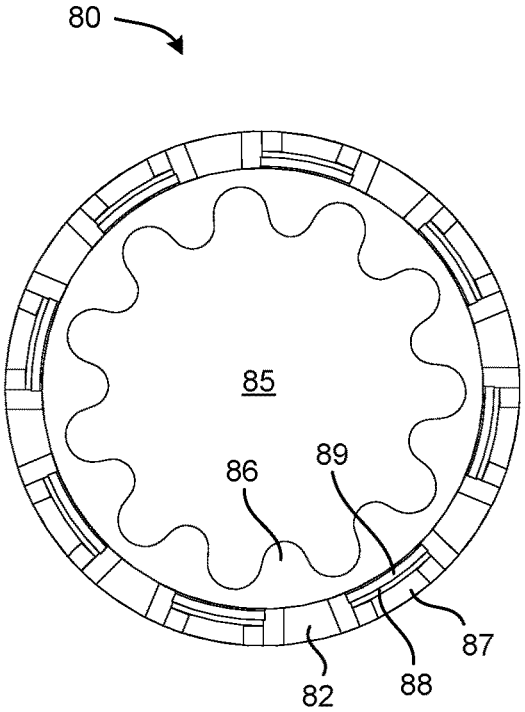
FIG. 11D illustrates a bottom view of the cap of FIG. 11A.

FIGS. 1A-1D illustrate various views of a socket assembly 1, according to some u examples of the present disclosure. Specifically, FIG. 1A illustrates a bottom perspective view of the socket assembly 1, FIG. 1B illustrates a top perspective view of the socket assembly 1, FIG. 1C illustrates a front side view of the socket assembly 1, and FIG. 1D illustrates a rear side view of the socket assembly 1. The socket assembly 1 may generally include a proximal end 2 and a distal end 3, which may also serve as a general reference for each of the individual components of the socket assembly 1. FIG. 2 illustrates an exploded view of the socket assembly 1, and FIG. 3 illustrates a cross-sectional view of the socket assembly 1 taken along the line A-A in FIG. 1D.

With reference to FIG. 2, individual components of the socket assembly 1 may generally include components that extend around a centrally located axis 5 of the socket assembly 1 (see FIG. 3), including a fastener socket 10, a resilient gripper ring 20, a first retaining ring 30, a wave spring 32, a second retaining ring 34, a lock-on sleeve 40, a lock-on ring 50, a reaction socket 60, a lock ring 70, and a cap 80. The fastener socket 10 may be configured to receive a fastener head therein (such as the hex nut 90 shown in FIG. 2, as just one non-limiting example of a fastener head). The fastener socket 10 can be configured to rotate around the axis 5 of the socket assembly 1. Moreover, the reaction socket 60 may be configured to couple with a reaction washer (such as the reaction washer 98 shown in FIG. 2, as one non-limiting example). However, it will be understood that the fastener socket 10 and/or the reaction socket 60 may be configured to receive and/or couple any style, size, or shape of fastener head and/or reaction washer that may be known or conceivable within the art.

Each component of the socket assembly 1 shown in FIG. 2 will now be discussed with reference to FIGS. 4A-11D, followed by a description of how each of these individual components may be assembled together to form the socket assembly 1 and how the socket assembly 1 may be utilized to perform its various functions.

Referring to FIGS. 4A-4D, a distal end of the fastener socket 10 may include a wall or side 11 that surrounds a fastener socket bore 13 configured to receive a fastener head therein (such as the hex nut 90 shown in FIG. 2). In some examples, the fastener socket bore 13 may comprise one or more fastener socket walls 16 and one or more fastener socket corners 17. In some examples, the fastener socket bore 13 may comprise a hexagonal shape (e.g., a "six-point" socket configuration) with six fastener socket walls 16 and six fastener socket corners 17 that may be shaped to receive the hex nut 90 therein. In some examples, the fastener socket bore 13 may comprise a "twelve-point" socket configuration with twelve fastener socket walls and twelve fastener socket corners (not shown). However, it will also be understood that the fastener socket bore 13 may comprise any size, style, or shape suitable for receiving any fastener head having a complementary size, style, and/or shape.

The fastener socket 10 may also include a window 15 (or a plurality of windows) formed through the side 11 of the fastener socket 10. In some examples, the window 15 may comprise a generally elongate shape. In some examples, the window 15 may comprise an obround shape. However, it will also be understood that the window 15 may comprise any conceivable size, style, or shape. In some examples, the window 15 may be located in one of the fastener socket corners 17. In some examples, a plurality of windows may each be located in a different fastener socket corner. In some examples, the plurality of windows may be spaced apart from each other at regular intervals. In some examples, the plurality of windows may be spaced apart from each other such that no two windows face each other from opposing fastener socket corners 17 that may be across from each other. In some examples, the plurality of windows may comprise three windows spaced apart from each other at 120-degree intervals. However, it will also be understood that any number of windows may be formed through the side 11 of the fastener socket 10 and may be placed according to any spacing, location, or pattern with respect to the side 11 of the fastener socket 10.

The fastener socket 10 may also include a taper 18 (or a plurality of tapers) formed adjacent the distal end of the fastener socket bore 13. The taper 18 may comprise a sloped surface, which can facilitate insertion of the hex nut 90 into the fastener socket bore 13. In some examples, at least a portion of the taper 18 may extend proximally into the fastener socket bore 13 up to a height that is equal to a height of at least a portion of the window 15. In some examples, at least a portion of the taper 18 may extend proximally above the window 15 formed through the side 11 of the fastener socket 10. In this manner, a height of the taper 18 relative to a height of the window 15 may be utilized to reduce, mitigate, and/or prevent stress risers that may be due to the window 15 formed through the side 11 of the fastener socket 10.

A proximal end of the fastener socket 10 may also include a torque reception feature 14 that may be configured to receive a complementary shaped torque transmission feature of a driver tool (not shown). In some examples, the torque reception feature 14, and/or the complementary shaped torque transmission feature of the driver tool, may each comprise a square drive shape. However, it will also be understood that the torque reception feature 14 and/or the complementary shaped torque transmission feature of the driver tool may each comprise any suitable number of shapes. For example, the torque reception feature 14 and/or the complementary shaped torque transmission feature of the driver tool may each include female and/or male members that mate together differently in different examples. For example, the torque reception feature 14 may include a female member as illustrated in FIGS. 4A-4D, or a male member in other examples. The proximal end of the fastener socket 10 may also include fastener socket threading 12, fastener socket splines 8, and a first retainer ring groove 9, as will be discussed in more detail below. The distal end of the fastener socket 10 may further include a resilient gripper ring groove 19 that may be configured to receive the resilient gripper ring 20.

Referring to FIGS. 5A-5D, the resilient gripper ring 20 may include a contact member 24 (or a plurality of contact members) that may be coupled to the resilient gripper ring 20. In some examples, in a locked position, the contact member 24 may extend through the window 15 in a first direction to engage the fastener head and lock the socket assembly 1 to the fastener head. In some examples, in an unlocked position, the contact member 24 may be retracted at least partially into the window 15 in a second direction to disengage the contact member 24 from the fastener head and unlock the socket assembly 1 from the fastener head.

In some examples, the contact member 24 may comprise a tang. In some examples, the tang may comprise a first tang projection 21 configured to engage a first surface 91 (e.g., see FIG. 2) of the fastener head adjacent a first edge 93 of the fastener head, and a second tang projection 22 configured to engage a second surface 92 of the fastener head. The first edge 93 of the fastener head may be intermediate the first surface 91 of the fastener head and the second surface 92 of the fastener head. In some examples, the tang may define a tang recess 23 intermediate the first tang projection 21 and the second tang projection 22. In some examples, the tang recess 23 may be configured to receive the first edge 93 of the fastener head, as the first tang projection 21 engages the first surface 91 of the fastener head and the second tang projection 22 engages the second surface 92 of the fastener head. In some examples, in a locked position, the tang may extend through the window 15 in a first direction to engage the first surface 91 of the fastener head with the first tang projection 21 and engage the second surface 92 of the fastener head with the second tang projection 22 in order to lock the socket assembly 1 to the fastener head. In some examples, in an unlocked position, the tang may be retracted at least partially into the window 15 in a second direction to disengage the first tang projection 21 from the first surface 91 of the fastener head and disengage the second tang projection 22 from the second surface 92 of the fastener head to unlock the socket assembly 1 from the fastener head. In some examples, the first tang projection 21 and the second tang projection 22 may each include curved or rounded surfaces that engage the first surface 91 and the second surface 92 of the fastener head. This may allow the tang to rotatably self-align with respect to the first edge 93 of the fastener head as the first tang projection 21 and/or the second tang projection 22 engage the fastener head.

In some examples, the contact member 24 may comprise a plurality of tangs spaced apart from each other and configured to extend through a plurality of windows to engage the fastener head and selectively lock and unlock the socket assembly 1 from the fastener head. In some examples, the plurality of tangs may be spaced apart from each other at regular intervals. In some examples, the plurality of tangs may be spaced apart from each other such that no two tangs face each other from opposing windows that may be oriented across from each other. In some examples, each of the plurality of tangs may be configured to rotatably self-align with respect to an edge of the fastener head as the plurality of tangs engage the fastener head. In some examples, the plurality of tangs may comprise three tangs spaced apart from each other at 120-degree intervals. However, it will also be understood that any number of tangs may be placed through corresponding windows formed in the fastener socket according to any spacing, location, or pattern with respect to the side 11 of the fastener socket 10.

In some examples, the contact member 24 may comprise a contact blade, such as the first tang projection 21 and/or second tang projection 22. In some examples, a contact blade may be configured to directly engage the first edge 93 of the fastener head in addition to or instead of engaging the first surface 91 and the second surface 92 of the fastener head. In some examples, the contact blade may comprise one or more edges that may be configured to directly engage the first edge 93 of the fastener head. In some examples, the contact blade may comprise a plurality of contact blades spaced apart from each other and configured to extend through a plurality of windows to engage edges of the fastener head and selectively lock and unlock the socket assembly 1 from the fastener head. In some examples, the plurality of contact blades may be spaced apart from each other at regular intervals. In some examples, the plurality of contact blades may be spaced apart from each other such that no two contact blades face each other from opposing windows that may be oriented across from each other. In some examples, each of the plurality of contact blades may be configured to rotatably self-align with respect to an edge of the fastener head as the plurality of contact blades each engage an edge of the fastener head. In some examples, the plurality of contact blades may comprise three contact blades spaced apart from each other at 120-degree intervals. However, it will also be understood that any number of contact blades may be placed through corresponding windows formed in the fastener socket according to any spacing, location, or pattern with respect to the side 11 of the fastener socket 10.

Referring to FIGS. 7A-7D, the lock-on sleeve 40 may generally include a lock-on sleeve body 41 surrounding a lock-on sleeve bore 42. A distal end of the lock-on sleeve 40 may include a cammed surface 43 and a tapered surface 44. In some examples, a proximal end of the lock-on sleeve 40 may include a lower shoulder 45 (see FIG. 3) and an upper shoulder 47. The upper shoulder 47 may act as a stop (against the bottom of the second retaining ring 34) to retain the lock-on sleeve 40 within the assembly when the lock-on ring 50 is rotated to allow the lock-on sleeve 40 to translate axially in the distal-to-proximal direction. In some examples, the lock-on sleeve 40 may also include an intermediate taper 48 (see FIG. 3) that may act as a stop for the lock-on sleeve 40 when translated axially in the proximal-to-distal direction. In some examples, a proximal end of the lock-on sleeve 40 may include lock-on sleeve splines 46 that may be configured to mate with the fastener socket splines 8 of the fastener socket 10 when the lock-on sleeve 40 is assembled to the fastener socket 10. In this manner, the lock-on sleeve 40 may be permitted to translate axially with respect to the fastener socket 10 along the fastener socket splines 8 in a proximal-to-distal direction toward the locked position and in a distal-to-proximal direction toward the unlocked position. In some examples, the cammed surface 43 may be configured to engage an outer perimeter of the resilient gripper ring 20 in order to selectively extend and retract the contact member 24 through the window 15. For example, in the locked position, the lock-on sleeve 40 may be translated in the proximal-to-distal direction to engage the resilient gripper ring 20 with a first portion of the cammed surface 43 (which may be thicker than a second portion of the cammed surface 43) to radially compress the resilient gripper ring 20 and extend the contact member 24 through the window 15 in order to lock the socket assembly 1 to the fastener head. Likewise, in the unlocked position, the lock-on sleeve 40 may be translated in the distal-to-proximal direction to engage the resilient gripper ring 20 with the second portion of the cammed surface 43 (which may be thinner than the first portion of the cammed surface 43) to radially decompress the resilient gripper ring 20 and allow the contact member 24 to at least partially retract into the window 15 and unlock the socket assembly 1 from the fastener head. In some examples, the cammed surface 43 is configured to engage the resilient gripper ring 20 with line contact (i.e., with no, or very little, surface contact between the cammed surface 43 and the resilient gripper ring 20) in order to minimize friction forces between the cammed surface 43 and the resilient gripper ring 20.

Referring to FIGS. 8A-8D, the lock-on ring 50 may generally include an outer gripping surface 53 surrounding a lock-on ring bore 52. The lock-on ring 50 may also include a proximal surface 54, a distal surface 55, and lock-on ring threading 51 formed within the lock-on ring bore 52. In some examples, the lock-on ring threading 51 may be configured to threadably couple with the fastener socket threading 12 of the fastener socket 10. In this manner, rotating the lock-on ring 50 in a first rotational direction with respect to the fastener socket 10 may translate the lock-on sleeve 40 in a first axial direction with respect to the fastener socket 10 to lock the socket assembly 1 to the fastener head, and rotating the lock-on ring 50 in a second rotational direction with respect to the fastener socket 10 may translate the lock-on sleeve 40 in a second axial direction with respect to the fastener socket 10 to unlock the socket assembly 1 from the fastener head. Accordingly, in some examples the lock-on ring 50 may function as a threaded actuator that is configured to be rotated to transform the socket assembly 1 between the locked position and the unlocked position.

Referring to FIGS. 9A-9D, the reaction socket 60 may generally include a reaction socket body 61 surrounding a reaction socket bore 62. In some examples, the reaction socket body 61 may include a taper 69. In some examples, a distal portion of the reaction socket body 61 may have a smaller diameter than a proximal portion of the reaction socket body 61. In this manner, the reaction socket 60 may be able to better fit between adjacent fastener heads that are relatively close to each other. In some examples, the proximal end of the reaction socket 60 may include a plurality of upper reaction socket castles 63 separated by a plurality of upper reaction socket recesses 64. In some examples, a height of the upper reaction socket castles 63 may be chosen to allow sufficient access to the outer gripping surface 53 of the lock-on ring 50 so that a user may be able to easily grip and rotate the lock-on ring 50, as described herein. Moreover, in some examples the outer gripping surface 53 of the lock-on ring 50 may be knurled (or include other structures thereon) to increase gripping friction to facilitate hand-tightening by a user.

In some examples, each of the upper reaction socket castles 63 may include a lower groove 66 and a locking groove 65, which will be discussed in more detail below. In some examples, the distal end of the reaction socket 60 may include a plurality of lower reaction socket castles 67 separated by a plurality of lower reaction socket recesses 68. In some examples, the lower reaction socket castles 67 and the lower reaction socket recesses 68 may be sized and shaped to receive complementary sized and shaped castles of a reaction washer (e.g., such as the reaction washer 98). However, it will be understood that the lower reaction socket castles 67 and the lower reaction socket recesses 68 may have style, size, or shape that may be suitable to receive any style, size, or shape of reaction washer known or conceivable within the art.

Referring to FIGS. 10A-10D, the lock ring 70 may generally include a lock ring body 73 surrounding a lock ring bore 74. The lock ring body 73 may include one or more apertures 72 configured to enable coupling of the one or more switches 71 (see FIG. 2) to the lock ring body 73. Fasteners such as pins (not shown) can extend into apertures in the switches 71 and into the apertures 72 in the lock ring body 73 to couple the switches 71 to the lock ring 70. In some examples, the distal end of the lock ring 70 may include a plurality of first locking members, or lock ring castles 77, which may be separated by a plurality of lock ring recesses 78. In some examples, each of the lock ring castles 77 may include a plurality of locking projections 79, as will be discussed in more detail below.

Referring to FIGS. 11A-11D, the cap 80 may generally include a cap body 84 surrounding a cap bore 85. In some examples, the cap body 84 may include one or more cap windows 83 formed therethrough and configured to receive one or more switches 71. In some examples, the proximal end of the cap 80 may include a driver tool connection feature 86 configured to receive a complementary shaped connection feature of a driver tool (not shown). For example, the driver tool connection feature 86 and/or the complementary shaped connection feature of a driver tool may each include female and/or male members that mate together differently in different examples. For example, the driver tool connection feature 86 may include a female member as illustrated in FIGS. 11A-11D, or a male member in other examples. In some examples, the cap body 84 may also include one or more cap apertures 4 (see FIG. 1C) configured to receive one or more locking members to secure the cap 80 to a driver tool. In some examples, the one or more cap apertures 4 may comprise one or more set screws 81 (see FIG. 2). In some examples, the distal end of the cap 80 may include a plurality of cap castles 87 separated by a plurality of cap recesses 82. In some examples, each of the cap castles 87 may include a first undercut 88 and a second undercut 89. The first undercut 88 may receive the second retaining ring 34 and the second undercut 89 may receive the locking projections 79 of the lock ring 70 (see FIG. 3), as will be discussed in more detail below.

An example process for assembling the socket assembly 1 will now be described. In general, the socket assembly 1 may comprise a reaction socket sub-assembly and a cap sub-assembly.

The resilient gripper ring 20 may be placed within the resilient gripper ring groove 19 of the fastener socket 10, and the first retaining ring 30 may be placed within the first retainer ring groove 9 of the fastener socket 10. The wave spring 32 may be placed on top of the first retaining ring 30 and the lock-on sleeve 40 may be placed over the fastener socket 10 (such that the fastener socket splines 8 and the lock-on sleeve splines 46 mesh together) with the lock-on sleeve 40 on top of the wave spring 32 in order to trap the wave spring 32 between a lower shoulder 45 (see FIG. 3) of the lock-on sleeve 40 and first retaining ring 30. In this manner, the wave spring 32 may impart a biasing force on the lock-on sleeve 40 that will tend to move the lock-on sleeve 40 axially in the distal-to-proximal direction with respect to the fastener socket 10. The lock-on ring 50 may then be threaded onto the fastener socket 10 to hold the lock-on sleeve 40 in place against the biasing force of the wave spring 32. Rotating the lock-on ring 50 may also axially translate the lock-on sleeve 40 between the locked and unlocked positions, as previously described herein. The assembly to this point may then be placed within the reaction socket bore 62 and the second retaining ring 34 may be placed within the lower groove 66 of the reaction socket 60 to retain the assembly within the reaction socket 60. The entire assembly to this point may be referred to as the "reaction socket sub-assembly."

In order to assemble the cap sub-assembly, the lock ring 70 may be placed within the cap bore 85 to protect the lock ring 70 against accidental damage (e.g., if the cap sub-assembly, which may or may not be coupled to a driver tool, is accidentally dropped). The switches 71 may be inserted through the one or more cap windows 83 that are formed through the cap 80. The switches 71 may be coupled to the lock ring 70 via the one or more apertures 72 formed through the lock ring 70 (e.g., via one or more pins (not shown) or with other suitable structures). In this manner, the switches 71 may function to retain the lock ring 70 within the cap bore 85 and allow the lock ring 70 to rotate within the cap bore 85 when the switches 71 translate back and forth within the one or more cap windows 83.

The parts of the socket assembly 1 can be made of suitable materials that have suitable properties for the structure and operation discussed herein. For example, materials may be used that have suitable values of strength, hardness, toughness, durability, stiffness, and/or resilience. For example, many of the components can be formed of types of steel that are sufficiently strong, hard, tough, durable, and stiff, such as types of steel that are used in tools. Other components, such as the first retaining ring 30, the second retaining ring 34, the wave spring 32, and the resilient gripper ring 20 may be made of materials with sufficient resilience for their operation, such as spring steel. The parts may be made with manufacturing techniques suitable for the individual parts, such as forming techniques (e.g., molding techniques), additive techniques (e.g., 3D printing techniques), subtractive techniques (e.g., milling, lathing, and/or cutting techniques) and/or shaping techniques (e.g., stamping and/or rolling techniques).

In some examples, the reaction socket sub-assembly and the cap sub-assembly may be coupled together to form the socket assembly 1.

In some examples, a socket assembly may include the cap 80 extending around the axis 5 of the socket assembly, the reaction socket 60 extending around the axis and a lock disposed inside the socket assembly. In some examples, the lock may comprise a first locking member of the lock ring 70, which may be configured to rotate around the axis from an unlocked or clearance position to a locked or interference position to engage a second locking member of the reaction socket 60. In the locked or interference position, the first locking member may be engaged with the second locking member to lock the cap 80 to the reaction socket 60. In the unlocked or clearance position, the first locking member may be disengaged from the second locking member to unlock the cap 80 from the reaction socket 60. In this manner, a reaction socket sub-assembly and a cap sub-assembly may be coupled to each other and decoupled from each other.

In some examples, the socket assembly may include one or more switches 71 coupled to the lock ring 70. The one or more switches 71 may protrude through the one or more cap windows 83 formed in the cap 80 to permit selective rotation of the lock ring 70 via the protruding switches 71.

In some examples, the one or more switches 71 protruding through the one or more cap windows 83 may permit the lock ring 70 to rotate about 10 degrees relative to the cap 80.

In some examples, the socket assembly may be configured to transform between the locked position and the unlocked position due to rotation of the one or more switches 71 relative to the cap 80.

In some examples, the first locking member may comprise a plurality of locking projections 79 and the second locking member may define a plurality of locking grooves 65. In the locked position, the plurality of locking projections 79 may be rotatably engaged with the plurality of locking grooves 65 to lock the cap 80 to the reaction socket 60. In the unlocked position, the plurality of locking projections 79 may be rotatably disengaged from the plurality of locking grooves 65 to unlock the cap 80 from the reaction socket 60.

In some examples, the reaction socket sub-assembly may be separated from the cap sub-assembly, the reaction socket sub-assembly may be coupled to a fastener head, and the cap sub-assembly may be coupled to a drive tool (not shown). In this manner, a plurality of reaction socket sub-assemblies may be coupled to a plurality of fastener heads. The cap sub-assembly (which may be coupled with the driver tool) may then be sequentially coupled with one of the reaction socket sub-assemblies at a time in order to speed up a plurality of tightening/loosening procedures that may be performed on the plurality of fastener heads coupled with the plurality of reaction socket sub-assemblies.

Figure 12:
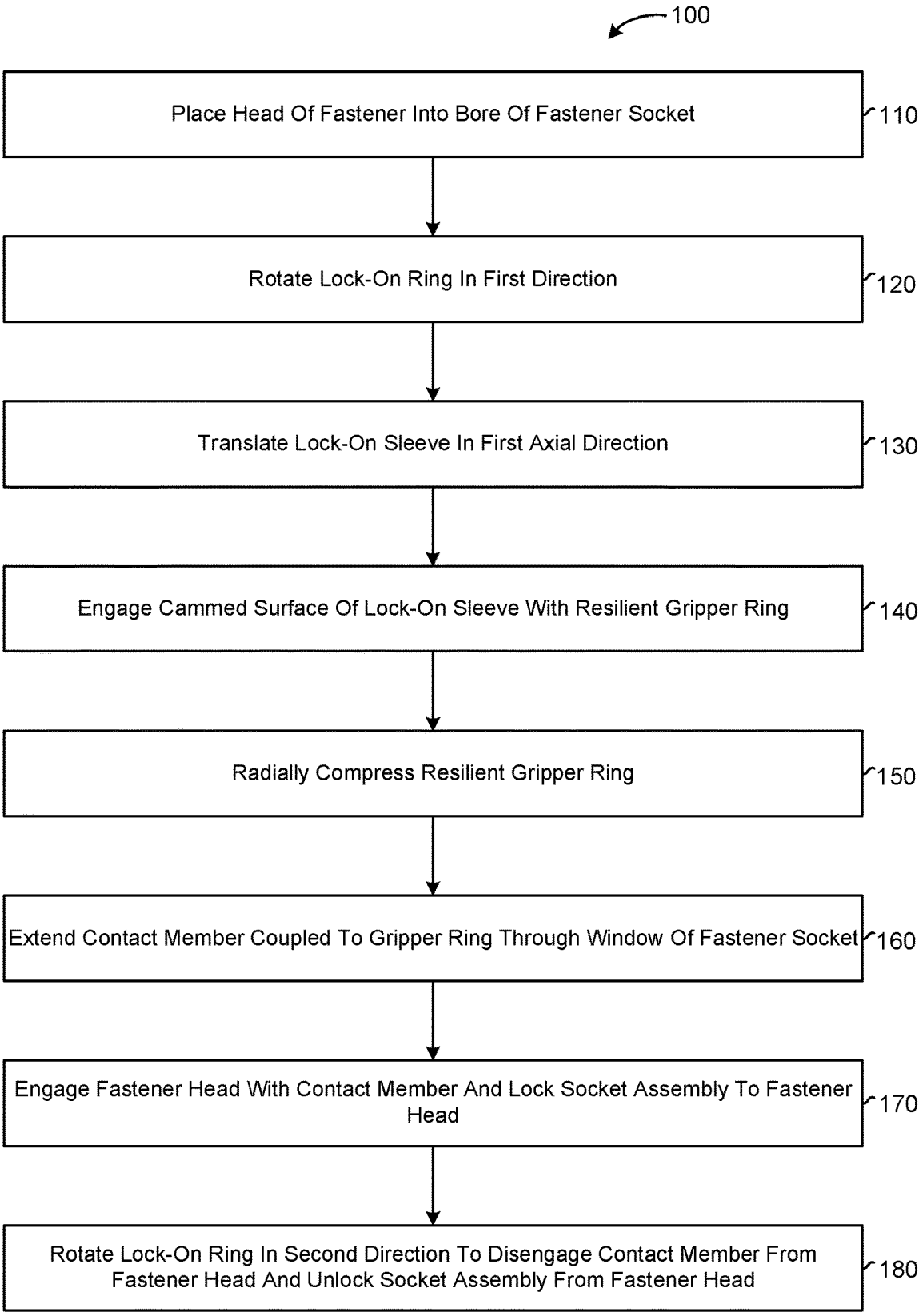
FIG. 12 illustrates a flow chart of a method for selectively locking a socket assembly to a fastener head, according to some examples of the present disclosure.

FIG. 12 illustrates a flow chart of a method 100 for selectively locking and unlocking a socket assembly to a fastener head, according to some examples of the present disclosure. In an act 110, a head of a fastener may be placed into a bore of a fastener socket, which may include moving the fastener and/or the fastener socket. Once the fastener head has been placed into the bore of the fastener socket, the method 100 may proceed to an act 120 in which a lock-on ring may be rotated in a first direction. In some examples, rotation of the lock-on ring in the first direction may cause a lock-on sleeve to translate in a first axial direction, in an act 130. In some examples, translation of the lock-on sleeve in the first axial direction may cause a cammed surface of the lock-on sleeve to engage a resilient gripper ring in an act 140, which may then radially compress the resilient gripper ring in an act 150. Radial compression of the resilient gripper ring by the cammed surface may cause a contact member coupled to the resilient gripper ring to extend through a window formed in the fastener socket in an act 160. The extended contact member may then engage the fastener head in an act 170 in order to lock the socket assembly to the fastener head. In an act 180, the lock-on ring may be rotated in a second direction to disengage the contact member from the fastener head and unlock the socket assembly from the fastener head.

Figure 13:
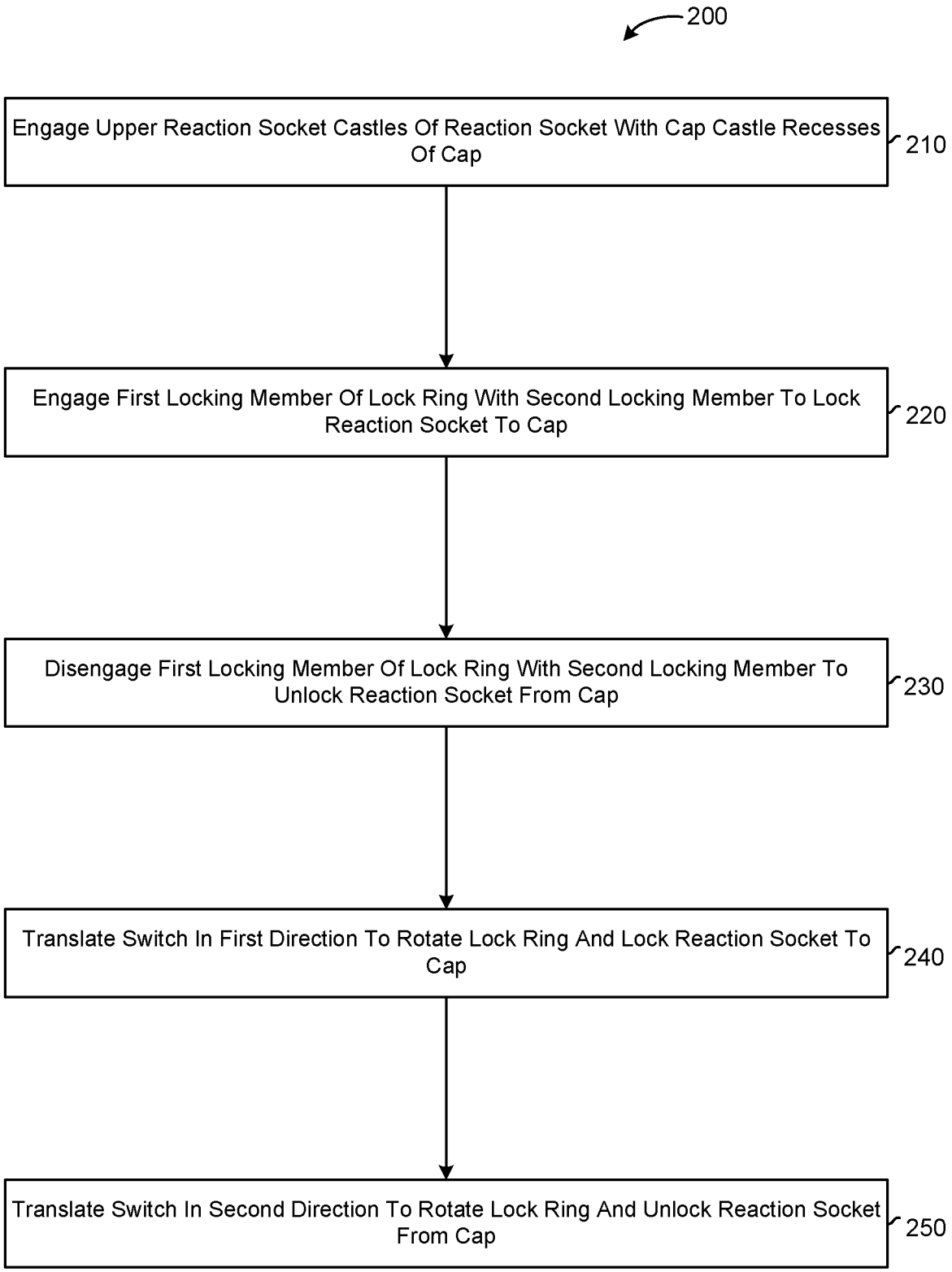
FIG. 13 illustrates a flow chart of a method for selectively locking a reaction socket to a cap, according to some examples of the present disclosure.

FIG. 13 illustrates a flow chart of a method 200 for selectively locking and unlocking a reaction socket to a cap, according to some examples of the present disclosure. In an act 210, a reaction socket may be aligned and joined with a cap such that one or more upper reaction socket castles of the reaction socket engage one or more cap castle recesses of the cap. Once the one or more upper reaction socket castles of the reaction socket have been engaged with the one or more cap castle recesses of the cap, the method 200 may proceed to an act 220 in which a first locking member of a lock ring may be engaged with a second locking member to lock the reaction socket to the cap, as previously discussed herein. In an act 230, the first locking member of the lock ring may be disengaged with the second locking member to unlock the reaction socket from the cap. Alternatively, or in addition thereto, some examples the method 200 may include acts 240 and 250. In act 240, a switch may be translated in a first direction to rotate the lock ring and lock the reaction socket to the cap. In act 250, the switch may be translated in a second direction to rotate the lock ring and unlock the reaction socket from the cap.

Any procedures or methods disclosed herein comprise one or more acts for performing the described method. The method acts may be interchanged with one another. In other words, unless a specific order of acts is required for proper operation, the order and/or use of specific acts may be modified.

Reference throughout this specification to "an example" or "the example" means that a particular feature, structure, or characteristic described in connection with that example is included in at least one example. Thus, the quoted phrases, or variations thereof, as recited throughout this specification are not necessarily all referring to the same example.

Similarly, it should be appreciated that in the above description, various features are sometimes grouped together in a single example, Figure, or description thereof for the purpose of streamlining the disclosure. This method of disclosure, however, is not to be interpreted as reflecting an intention that any example requires more features than those expressly recited in that example. Rather, inventive aspects may lie in a combination of fewer than all features of any single foregoing disclosed example.

Recitation of the term "first" with respect to a feature or element does not necessarily imply the existence of a second or additional such feature or element. Elements recited in means-plus-function format are intended to be construed in accordance with 35 U.S.C. § 112 Para. 6. It will be apparent to those having skill in the art that changes may be made to the details of the above-described examples without departing from the underlying principles set forth herein.

While specific examples and applications of the present disclosure have been illustrated and described, it is to be understood that the scope of this disclosure is not limited to the precise configuration and components disclosed herein. Various modifications, changes, and variations which will be apparent to those skilled in the art may be made in the arrangement, operation, and details of the methods and systems disclosed herein.

What is claimed is:

1. A socket assembly comprising:

a fastener socket configured to receive a fastener head therein, the fastener socket comprising a window formed through a side of the fastener socket; and a tang comprising:

a first tang projection configured to engage a first surface of the fastener head adjacent a first edge of the fastener head; and a second tang projection configured to engage a second surface of the fastener head, the first edge of the fastener head intermediate the first surface of the fastener head and the second surface of the fastener head, the tang defining a tang recess intermediate the first tang projection and the second tang projection, the tang recess configured to receive the first edge of the fastener head as the first tang projection engages the first surface of the fastener head and the second tang projection engages the second surface of the fastener head;

wherein:

in a locked position, the tang extends through the window in a first direction to engage the first surface of the fastener head with the first tang projection and engage the second surface of the fastener head with the second tang projection to lock the socket assembly to the fastener head; and in an unlocked position, the tang is retracted at least partially into the window in a second direction to disengage the first tang projection from the first surface of the fastener head and disengage the second tang projection from the second surface of the fastener head to unlock the socket assembly from the fastener head.

2. The socket assembly of claim 1, comprising:

a plurality of windows formed through the side of the fastener socket and spaced apart from each other, the plurality of windows comprising the window; and a plurality of tangs spaced apart from each other, the plurality of tangs comprising the tang, wherein the plurality of tangs are configured to extend through the plurality of windows and engage the fastener head to selectively lock and unlock the socket assembly from the fastener head.

3. The socket assembly of claim 2, wherein:

the plurality of windows comprises three windows spaced apart from each other at 120 degree intervals; and the plurality of tangs comprises three tangs spaced apart from each other at 120 degree intervals.

4. The socket assembly of claim 2, wherein each of the plurality of tangs is configured to rotatably self-align with an edge of the fastener head as the plurality of tangs engage the fastener head.

5. The socket assembly of claim 1, comprising:

a resilient gripper ring, wherein the tang is coupled to the resilient gripper ring; and a lock-on sleeve comprising a cammed surface configured to engage the resilient gripper ring to selectively extend and retract the tang through the window, wherein:

in the locked position, the lock-on sleeve is translated along a first direction to engage the resilient gripper ring with a first portion of the cammed surface to radially compress the resilient gripper ring and extend the tang through the window to lock the socket assembly to the fastener head; and in the unlocked position, the lock-on sleeve is translated along a second direction to engage the resilient gripper ring with a second portion of the cammed surface to radially decompress the resilient gripper ring and retract the tang through the window to unlock the socket assembly from the fastener head.

6. The socket assembly of claim 5, comprising:

a lock-on ring comprising first threading configured to threadably couple with second threading of the fastener socket, wherein:

rotating the lock-on ring in a first rotational direction with respect to the fastener socket translates the lock-on sleeve in a first axial direction with respect to the fastener socket to lock the socket assembly to the fastener head; and rotating the lock-on ring in a second rotational direction with respect to the fastener socket translates the lock-on sleeve in a second axial direction with respect to the fastener socket to unlock the socket assembly from the fastener head.

7. The socket assembly of claim 1, wherein a bore of the fastener socket comprises a taper having a portion that extends above the window that is formed through the side of the fastener socket.

8. A socket assembly comprising:

a fastener socket configured to receive a fastener head therein, the fastener socket comprising a window formed through a side of the fastener socket;

a contact member configured to engage the fastener head; and a threaded actuator that is configured to be rotated to transform the socket assembly between a locked position and an unlocked position;

wherein:

in the locked position, the contact member extends through the window in a first direction to engage the fastener head and lock the socket assembly to the fastener head; and in the unlocked position, the contact member is retracted at least partially into the window in a second direction to disengage the contact member from the fastener head and unlock the socket assembly from the fastener head.

9. The socket assembly of claim 8, wherein the contact member comprises a contact blade configured to engage the fastener head.

10. The socket assembly of claim 9, comprising:

a plurality of windows formed through the side of the fastener socket and spaced apart from each other, the plurality of windows comprising the window; and a plurality of contact blades spaced apart from each other, wherein the plurality of contact blades are configured to extend through the plurality of windows and engage the fastener head to selectively lock and unlock the socket assembly from the fastener head.

11. The socket assembly of claim 10, wherein:

the plurality of windows comprises three windows spaced apart from each other at 120 degree intervals; and the plurality of contact blades comprises three contact blades spaced apart from each other at 120 degree intervals.

12. The socket assembly of claim 8, wherein the contact member comprises a tang, the tang comprising:

a first tang projection configured to engage a first surface of the fastener head adjacent a first edge of the fastener head; and a second tang projection configured to engage a second surface of the fastener head, the first edge of the fastener head intermediate the first surface of the fastener head and the second surface of the fastener head, the tang defining a tang recess intermediate the first tang projection and the second tang projection, the tang recess configured to receive the first edge of the fastener head as the first tang projection engages the first surface of the fastener head and the second tang projection engages the second surface of the fastener head;

wherein:

in the locked position, the tang extends through the window in a first direction to engage the first surface of the fastener head with the first tang projection and engage the second surface of the fastener head with the second tang projection to lock the socket assembly to the fastener head; and in the unlocked position, the tang is retracted at least partially into the window in the second direction to disengage the first tang projection from the first surface of the fastener head and disengage the second tang projection from the second surface of the fastener head to unlock the socket assembly from the fastener head.

13. The socket assembly of claim 12, comprising:

a plurality of windows formed through the side of the fastener socket and spaced apart from each other, the plurality of windows comprising the window; and a plurality of tangs spaced apart from each other, the plurality of tangs comprising the tang, wherein the plurality of tangs are configured to extend through the plurality of windows and engage the fastener head to selectively lock and unlock the socket assembly from the fastener head.

14. The socket assembly of claim 13, wherein:

the plurality of windows comprises three windows spaced apart from each other at 120 degree intervals; and the plurality of tangs comprises three tangs spaced apart from each other at 120 degree intervals.

15. The socket assembly of claim 14, wherein each of the plurality of tangs is configured to rotatably self-align with an edge of the fastener head as the plurality of tangs engage the fastener head.

* * * * *